US008517797B2

(12) United States Patent
Kumeno et al.

(10) Patent No.: US 8,517,797 B2
(45) Date of Patent: Aug. 27, 2013

(54) GRINDING MACHINE AND GRINDING METHOD

(75) Inventors: Toshiki Kumeno, Kashihara (JP); Masashi Yoritsune, Anjo (JP); Takashi Matsumoto, Kariya (JP); Kazuyoshi Ohtsubo, Chiryu (JP)

(73) Assignee: JTEKT Corporation, Osaka-shi (JP)

( * ) Notice: Subject to any disclaimer, the term of this patent is extended or adjusted under 35 U.S.C. 154(b) by 429 days.

(21) Appl. No.: 12/908,355

(22) Filed: Oct. 20, 2010

(65) Prior Publication Data

US 2011/0097971 A1 Apr. 28, 2011

(30) Foreign Application Priority Data

Oct. 28, 2009 (JP) ..... 2009-247169
Jan. 7, 2010 (JP) ..... 2010-001656

(51) Int. Cl.
*B24B 49/00* (2012.01)

(52) U.S. Cl.
USPC ..... 451/5; 451/8; 451/11; 451/49; 451/51; 451/231

(58) Field of Classification Search
USPC ..... 451/5, 8, 11, 49, 51, 180, 231
See application file for complete search history.

(56) References Cited

U.S. PATENT DOCUMENTS 3,089,291 A * 5/1963 Humes et al. ..... 451/242
4,713,914 A * 12/1987 Oshima ..... 451/11
5,562,523 A * 10/1996 Asano et al. ..... 451/1
5,679,053 A * 10/1997 Sakakura et al. ..... 451/5
6,113,461 A * 9/2000 Onoda et al. ..... 451/5

FOREIGN PATENT DOCUMENTS

JP 7-214466 8/1995
JP 8-168957 7/1996

OTHER PUBLICATIONS

U.S. Appl. No. 13/394,352, filed Mar. 6, 2012, Kumeno, et al.

* cited by examiner

*Primary Examiner* — Maurina Rachuba
(74) *Attorney, Agent, or Firm* — Oblon, Spivak, McClelland, Maier & Neustadt, L.L.P.

(57) ABSTRACT

In a grinding machine, a retraction grinding is performed after a first advance grinding. Within a rotational range for a cylindrical workpiece to rotate from a present rotational phase to a target rotational phase in the retraction grinding, target grinding resistances in respective rotational phases are generated based on residual grinding amounts in the respective rotational phases of the cylindrical workpiece. Then, the retraction grinding is performed and controlled to make a grinding resistance detected by a force sensor agree with the target grinding resistances in respective rotational phases.

20 Claims, 26 Drawing Sheets

Work Spindle Center
W
43 t2
W
43 t3
W
43 t4
W
43 t5
ωmax

GRINDING MACHINE AND GRINDING METHOD

INCORPORATION BY REFERENCE

This application is based on and claims priority under 35 U.S.C. 119 with respect to Japanese patent applications No. 2009-247169 filed on Oct. 28, 2009 and No. 2010-001656 filed on Jan. 7, 2010, the entire contents of which are incorporated herein by reference.

BACKGROUND OF THE INVENTION

1. Field of the Invention

The present invention relates to a grinding machine and a grinding method for grinding an outer or internal surface of a cylindrical workpiece.

2. Discussion of the Related Art

Heretofore, as grinding machines for grinding an outer or internal surface of a cylindrical workpiece, there have been known those which are described in JP7-214466 A (hereafter referred to as Patent Document 1) and JP8-168957 A (hereafter referred to as Patent Document 2). Each of the Patent Documents 1 and 2 describes performing a retraction grinding. The retraction grinding referred to herein means a grinding which is carried out as a grinding wheel is moved in a direction to go away from a cylindrical workpiece, after an advance grinding which is carried out by moving the grinding wheel in a direction to be pressed against the cylindrical workpiece. In the advance grinding, a bending or deformation occurs on the cylindrical workpiece because the grinding wheel is pressed against the cylindrical workpiece. Further, in the advance grinding, a residual grinding amount E(θ) differs in dependence upon the rotational phase θ of the cylindrical workpiece. Then, in the retraction grinding, a residual grinding portion which was left without being ground in the advance grinding is ground as the amount of the bending which occurred on the cylindrical workpiece in the advance grinding is decreased. By performing the retraction grinding in this way, it becomes possible to remarkably shorten the grinding period of time in comparison with that taken where the whole of the grinding is performed by the advance grinding.

SUMMARY OF THE INVENTION

It is therefore an object of the present invention to provide a grinding machine and a grinding method capable of performing a more precise grinding by utilizing the retraction grinding described in each of the Patent Documents 1 and 2.

Briefly, according to the present invention in a first aspect, there is provided a grinding machine for grinding an external or internal surface of a cylindrical workpiece. The grinding machine comprises a grinding wheel; a workpiece support device for rotatably supporting and driving the cylindrical workpiece; a feed device for relatively moving the cylindrical workpiece and the grinding wheel to move the cylindrical workpiece and the grinding wheel toward and away from each other; grinding resistance detection means for detecting a grinding resistance which is generated by grinding the cylindrical workpiece with the grinding wheel; first advance grinding control means for performing a first advance grinding in which the grinding wheel is relatively moved in a first direction to be pressed on the cylindrical workpiece to increase a bending amount ω of the cylindrical workpiece; target grinding resistance generation means for generating target grinding resistances Fe(θ) in respective rotational phases θ based on residual grinding amounts E(θ) in the respective rotational phases θ of the cylindrical workpiece within a rotational range for the cylindrical workpiece to rotate from a present rotational phase θt to a target rotational phase θe in a retraction grinding which is to be performed following the first advance grinding in such a way as to relatively move the grinding wheel in a second direction to go away from the cylindrical workpiece as the bending amount ω of the cylindrical workpiece is decreased; and retraction grinding control means for executing and controlling the retraction grinding to make the grinding resistance Ft detected by the grinding resistance detection means agree with the target grinding resistances Fe(θ) in the respective rotational phases θ of the cylindrical workpiece.

With the construction in the first aspect, the retraction grinding is controlled on the basis of the grinding resistance Ft. The grinding amount and the grinding resistance (a resistance generated by grinding the cylindrical workpiece) are in proportion to each other. That is, if residual grinding amounts E(θ) in the respective rotational phases θ can be grasped, it is possible to set the target grinding resistances Fe(θ) which are proportional to the residual grinding amounts E(θ). Therefore, in the retraction grinding, it is possible to perform a feedback control depending on the grinding resistance Ft by using the target grinding resistances Fe(θ) as command values in the respective rotational phases θ. As a result, it is possible to enhance the machining accuracy of the cylindrical workpiece ground in the retraction grinding. Although in a certain condition, the grinding resistance Ft detected by the grinding resistance detection means agrees with a grinding resistance generated by the physical contact between the workpiece and the grinding wheel, the grinding resistance Ft in another condition becomes the sum of the grinding resistance due to the physical contact and the influence of a dynamic pressure effect brought about by, e.g., coolant fluid. That is, the grinding resistance Ft means at least the grinding resistance due to the physical contact.

The present invention in a second aspect provides a grinding machine for grinding an external or internal surface of a cylindrical workpiece. The grinding machine comprises a grinding wheel; a workpiece support device for rotatably supporting and driving the cylindrical workpiece; a feed device for relatively moving the cylindrical workpiece and the grinding wheel to move the cylindrical workpiece and the grinding wheel toward and away from each other; advance grinding control means for performing an advance grinding in which the grinding wheel is relatively moved in a first direction to be pressed on the cylindrical workpiece to increase a total bending amount value δ(t) which is a total value of a bending amount of the cylindrical workpiece and a bending amount of the grinding wheel; target bending amount generation means for generating target total bending amount values δ(t) of the cylindrical workpiece and the grinding wheel at respective times t within a rotational range for the cylindrical workpiece to rotate from a present rotational phase θt to a target rotational phase θe in a retraction grinding which is to be performed following the advance grinding in such a way as to relatively move the grinding wheel in a second direction to go away from the cylindrical workpiece as the total bending amount value δ(t) of the cylindrical workpiece and the grinding wheel is decreased; position command value generation means for generating relative position command values $X_{ref}$(t) at the respective times t of the grinding wheel relative to the cylindrical workpiece, based on the target total bending amount values δ(t); and retraction grinding control means for controlling the feed device based on the position command values $X_{ref}$(t) to execute the retraction grinding.

With the construction in the second aspect, the relative position command values $X_{ref}$(t) at the respective times t of the grinding wheel relative to the cylindrical workpiece are generated based on the target total bending amount values δ(t) of the cylindrical workpiece and the grinding wheel, and the retraction grinding is performed based on the relative position command values $X_{ref}(t)$. It is known that the total bending amount value δ(t) of the cylindrical workpiece and the grinding wheel and the grinding amount E(t) are in proportion to each other. That is, by changing the relative position between the cylindrical workpiece and the grinding wheel on the basis of the total bending amount values at the respective times t, a desired grinding amount can be attained, so that it is possible to realize a precise retraction grinding.

The present invention in a third aspect provides a grinding method of grinding an external or internal surface of a cylindrical workpiece in a grinding machine which comprises a grinding wheel; a workpiece support device for rotatably supporting and driving the cylindrical workpiece; a feed device for relatively moving the cylindrical workpiece and the grinding wheel to move the cylindrical workpiece and the grinding wheel toward and away from each other; and grinding resistance detection means for detecting a grinding resistance Ft which is generated by grinding the cylindrical workpiece with the grinding wheel. The grinding method comprises a first advance grinding step of performing a first advance grinding by relatively moving the grinding wheel in a first direction to be pressed on the cylindrical workpiece to increase a bending amount ω of the cylindrical workpiece; a target grinding resistance generation step of generating target grinding resistances Fe(θ) in respective rotational phases θ based on residual grinding amounts E(θ) in the respective rotational phases θ of the cylindrical workpiece within a rotational range for the cylindrical workpiece to rotate from a present rotational phase θt to a target rotational phase θe in a retraction grinding which is to be performed following the first advance grinding by moving the grinding wheel in a second direction to go away from the cylindrical workpiece as the bending amount ω of the cylindrical workpiece is decreased; and a retraction grinding control step of executing and controlling the retraction grinding to make the grinding resistance Ft detected by the grinding resistance detection means agree with the target grinding resistances Fe(θ) in the respective rotational phases θ of the cylindrical workpiece.

With the construction in the third aspect, it is possible to achieve the same effects and advantages as those in the foregoing grinding machine in the first aspect.

The present invention in a fourth aspect provides a grinding method of grinding an external or internal surface of a cylindrical workpiece in a grinding machine which comprises a grinding wheel; a workpiece support device for rotatably supporting and driving the cylindrical workpiece; and a feed device for relatively moving the cylindrical workpiece and the grinding wheel to move the cylindrical workpiece and the grinding wheel toward and away from each other. The grinding method comprises an advance grinding step of performing an advance grinding by relatively moving the grinding wheel in a first direction to be pressed on the cylindrical workpiece to increase a total bending amount value δ(t) which is a total value of a bending amount of the cylindrical workpiece and a bending amount of the grinding wheel; a target bending amount generation step of generating target total bending amount values δ(t) at respective times t of the cylindrical workpiece and the grinding wheel within a rotational range for the cylindrical workpiece to rotate from a present rotational phase θt to a target rotational phase θe in a retraction grinding which is to be performed following the advance grinding by relatively moving the grinding wheel in a second direction to go away from the cylindrical workpiece as the total bending amount value δ(t) of the cylindrical workpiece and the grinding wheel is decreased; a position command value generation step of generating relative position command values $X_{ref}(t)$ at the respective times t of the grinding wheel relative to the cylindrical workpiece, based on the target total bending amount values δ(t); and a retraction grinding control step of controlling the feed device based on the position command values $X_{ref}(t)$ to execute the retraction grinding.

With the construction in the fourth aspect, it is possible to achieve the same effects and advantages as those in the foregoing grinding machine in the second aspect.

BRIEF DESCRIPTION OF THE DRAWINGS

The foregoing and other objects and many of the attendant advantages of the present invention may readily be appreciated as the same becomes better understood by reference to the preferred embodiments of the present invention when considered in connection with the accompanying drawings, wherein like reference numerals designate the same or corresponding parts throughout several views, and in which:

FIG. 29(*b*) shows a typical behavior of grinding resistance F(t) for the period (t1-t4); and FIG. 29(*c*) shows a typical behavior of total bending amount value δ(t) for the period (t1-t4);

DETAILED DESCRIPTION OF THE PREFERRED EMBODIMENTS (First Embodiment)

Hereafter, a grinding machine in a first embodiment will be described with reference to FIGS. 1 to 6. A grinding method practiced on the grinding machine in the first embodiment is a method of performing a first advance grinding and then, performing a retraction grinding. In the first advance grinding, a position control is carried out to maintain the feed rate of a wheel head 42 constant. In the retraction grinding, another control is carried out to make the grinding resistance Ft follow or agree with a target grinding resistance Fe.

(Construction of Grinding Machine)

A cylindrical grinding machine of a wheel head traverse type will be described by way of an example of the grinding machine in the present embodiment. Further, a cylindrical workpiece such as camshaft or crankshaft will be exemplified as a workpiece which is an object to be machined on the grinding machine. However, so far as the workpiece is cylindrical, it may be any other workpiece than camshaft and crankshaft. The term "cylindrical" herein means to encompass a case that the external surface shape in section perpendicular to the axis of the workpiece is circular, another case that the internal surface shape in section perpendicular to the axis of the workpiece is circular and a further case that the workpiece has both of such outer and internal surfaces. That is, the meaning of a cylindrical workpiece W includes a workpiece like a cylindrical bar or shaft.

Figure 1:
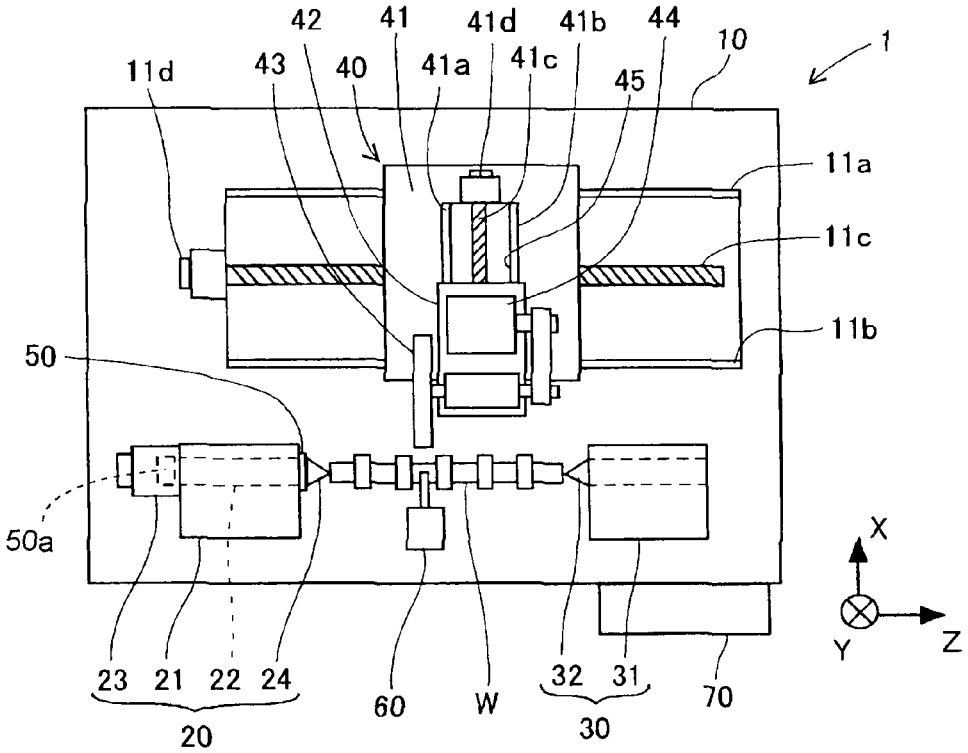
FIG. 1 is a schematic plan view of a grinding machine common to first to eighth embodiments according to the present invention.

The grinding machine will be described with reference to FIG. 1. As shown in FIG. 1, the grinding machine 1 is composed of a bed 10, a work head 20, a foot stock 30, a grinding wheel support device 40, a force sensor 50, a sizing device 60 and a controller 70.

The bed 10 takes an approximately rectangular shape and installed on a floor. However, the shape of the bed 10 should not be limited to the rectangular shape. On the bed 10, a pair of wheel head guide rails 11*a*, 11*b* are formed to extend in the left-right direction (Z-axis direction) in FIG. 1 and in parallel to each other. The pair of wheel head guide rails 11*a*, 11*b* are rails on which a wheel head traverse table 41 constituting the grinding wheel support device 40 is slidable. Further, on the bed 10, a wheel head Z-axis ball screw shaft 11*c* for driving the wheel head traverse table 41 in the left-right direction in FIG. 1 is arranged between the pair of wheel head guide rails 11*a*, 11*b*, and a wheel head Z-axis motor 11*d* is arranged for rotationally driving the wheel head Z-axis ball screw shaft 11*c*.

The work head 20 (corresponding to a workpiece support device in the claimed invention) is provided with a work head main body 21, a work spindle 22, a work spindle motor 23 and a work head center 24. The work head main body 21 is fixed on a left-lower part as viewed in FIG. 1 of an upper surface of the bed 10. The position in the Z-axis direction of the work head main body 21 is adjustable slightly. Inside of the work head main body 21, the work spindle 22 is inserted and supported to be rotatable about its axis (about the Z-axis in FIG. 1). The work spindle 22 is provided at its left end as viewed in FIG. 1 with the work spindle motor 23, and the work spindle 22 is rotationally driven by the work spindle motor 23 relative to the work head main body 21. The work spindle motor 23 is provided with an encoder (not numbered), by which it is possible to detect the rotational angle of the work spindle motor 23. Further, the work head center 24 for supporting an axial one end of a shaft-like workpiece W is attached on the right end of the work spindle 22.

The foot stock 30 (also corresponding to the workpiece support device in the claimed invention) is provided with a foot stock main body 31 and a foot stock center 32. The foot stock main body 31 is fixed to the right-lower part as viewed in FIG. 1 on the upper surface of the bed 10. The position in the Z-axis of the foot stock main body 31 is adjustable through a somewhat long distance relative to the bed 10. On the foot stock main body 31, the foot stock center 32 is provided not to be rotatable relative to the foot stock main body 31. The axis of the foot stock center 32 is positioned in axial alignment with the rotational axis of the work spindle 22.

Then, the foot stock center 32 supports the other end in the axial direction of the workpiece W. That is, the foot stock center 32 is arranged to face the work head center 24. Thus, the work head center 24 and the foot stock center 32 rotatably support the opposite ends of the workpiece W. Further, the foot stock center 32 is adjustable with the protruding amount from the left end surface of the foot stock main body 31. That is, the protruding amount of the foot stock center 32 is adjustable in dependence on the position of the workpiece W. In this way, the workpiece W is held by the work head center 24 and the foot stock center 32 to be rotatable about the work spindle axis (i.e., about the Z-axis).

The grinding wheel support device 40 is provided with the wheel head traverse base 41, a wheel head 42, a grinding wheel 43, a wheel drive motor 44 and a linear scale 45. The wheel head traverse base 41 is formed to take a rectangular shape like a flat plate and is arranged to be slidable along a pair of wheel head guide rails 11*a*, 11*b* on the bed 10. The wheel head traverse base 41 is connected to a nut member (not shown) on the wheel head Z-axis ball screw 11*c* and is moved along the pair of wheel head guide rails 11*a*, 11*b* by the operation of the wheel head Z-axis motor 11*d*. The wheel head Z-axis motor 11*d* has an encoder (not numbered), by which it is possible to detect the rotational angle of the wheel head Z-axis motor 11*d*.

On the upper surface of the wheel head traverse base 41, a pair of X-axis guide rails 41*a*, 41*b* along which the wheel head 42 is slidable are formed to extend in an X-axis direction (i.e., the vertical direction as viewed in FIG. 1) and in parallel to each other. Further, on the wheel head traverse base 41, an X-axis ball screw 41*c* for driving the wheel head 42 in the X-axis direction is arranged between the pair of X-axis guide rails 41*a*, 41*b*, and an X-axis motor 41*d* is arranged therebetween for rotationally driving the X-axis ball screw 41*c*. The X-axis motor 41*d* has an encoder (not numbered), by which it is possible to detect the rotational angle of the X-axis motor 41*d*.

The wheel head 42 is slidably arranged along the pair of X-axis guide rails 41*a*, 41*b* on the upper surface of the wheel head traverse base 41. Further, the wheel head 42 is connected to a nut member (not shown) on the X-axis ball screw 41*c* and is moved along the pair of X-axis guide rails 41*a*, 41*b* by the operation of the X-axis motor 41*d*. That is, the wheel head 42 is relatively movable in the X-axis direction (plunge feed direction) and the Z-axis direction (traverse feed direction) relative to the bed 10, the work head 20 and the foot stock 30.

Further, the wheel head 42 is formed at a lower part thereof as viewed in FIG. 1 with a through bore extending in the left-right direction as viewed in FIG. 1. A wheel spindle member (not numbered) is supported in the through bore to be rotatable about a wheel spindle axis thereof parallel to the Z-axis. A disc-like grinding wheel 43 is coaxially attached on one end (the left end as viewed in FIG. 1) of the wheel spindle member. That is, the grinding wheel 43 is supported by the wheel head 42 in a cantilever fashion. More specifically, the right end of the grinding wheel 43 as viewed in FIG. 1 is an end supported by the wheel head 42, whereas the left end of the grinding wheel 43 as viewed in FIG. 1 is a free end. The rotational axis of the grinding wheel 43 extends in parallel to the rotational axis of the work spindle 22. Further, the wheel drive motor 44 is fixedly mounted on the upper surface of the wheel head 42. A driving belt (not numbered) is wound between a pair of pulleys (not shown) respectively attached to the other end (the right end as viewed in FIG. 1) of the wheel spindle member and a spindle of the wheel drive motor 44, and the grinding wheel 43 is rotated about the wheel spindle axis by the operation of the wheel drive motor 44.

The linear scale 45 is provided along the X-axis guide rail 41*a* and is able to detect the X-axis position of the wheel head 42 relative to the wheel head traverse base 41. That is, the linear scale 45 is able to detect the X-axis position of the grinding wheel 43 relative to the wheel head traverse base 41.

A force sensor 50 (corresponding to "grinding resistance detection means" in the claimed invention) is incorporated in the work spindle 22 and measures a force component in the X-axis direction (e.g., normal component at a grinding point) of the force acting on the work spindle 22. That is, the force sensor 50 detects a grinding resistance Ft in the normal direction which is developed as a result that the workpiece W is ground (pressed) with the grinding wheel 43. In this particular embodiment, since the grinding is performed by moving the grinding wheel 43 relative to the workpiece W in the X-axis direction only, the force sensor 50 is to measure the force in the X-axis direction component only. A signal issued from the force sensor 50 is outputted to the controller 70.

The sizing device 60 measures the outer diameter Dt (corresponding to the "ground diameter" in the claimed invention) at a grinding position on the workpiece W. The outer diameter Dt of the workpiece W measured by the sizing device 60 is outputted to the controller 70.

The controller 70 (corresponding to or serving as various "generation means", various "control means", "inference means" and the like in the claimed invention) controls the grinding operation on the external surface of the workpiece W by controlling the respective motors to rotate the workpiece W about the work spindle axis, to rotate the grinding wheel 43 and to change the positions in the Z and X-axis directions of the grinding wheel 43 relative to the workpiece W. The controller 70 is operable in either of two modes including a position control mode depending on respective position information detected by the respective encoders and a resistance control mode depending on a grinding resistance detected by the force sensor 50. The details of the two modes will be described later.

(Grind Method)

Figure 2:
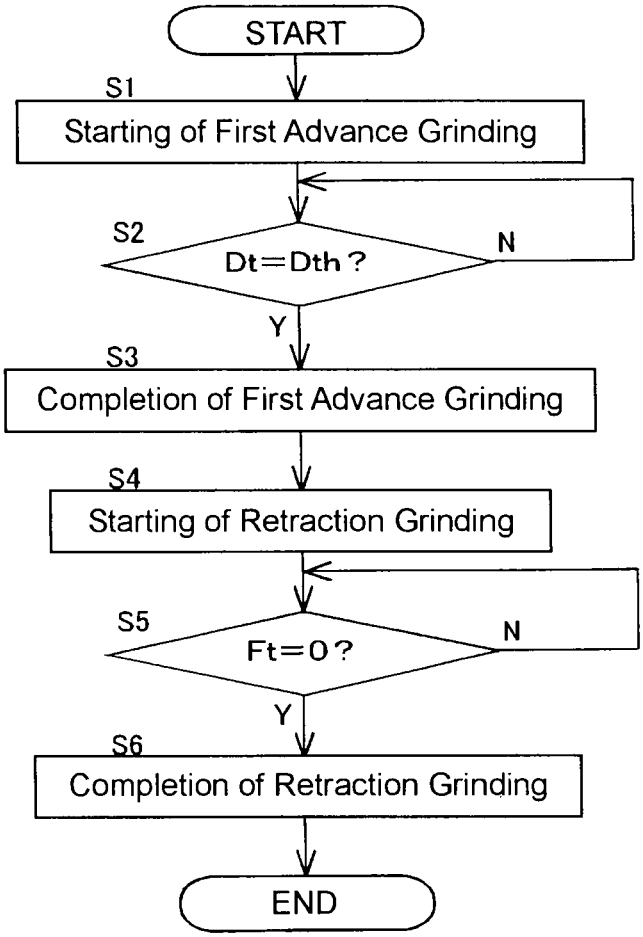
FIG. 2 is a flowchart showing a grinding method practiced on the grinding machine in the first embodiment.
Figure 4:
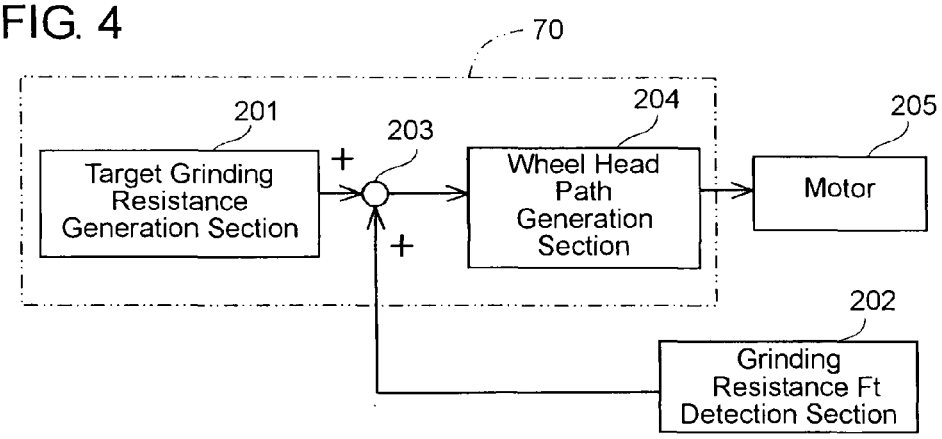
FIG. 4 is a control block diagram used for a retraction grinding in the first embodiment.
Figures 5A, 5B, 5C, 5D:
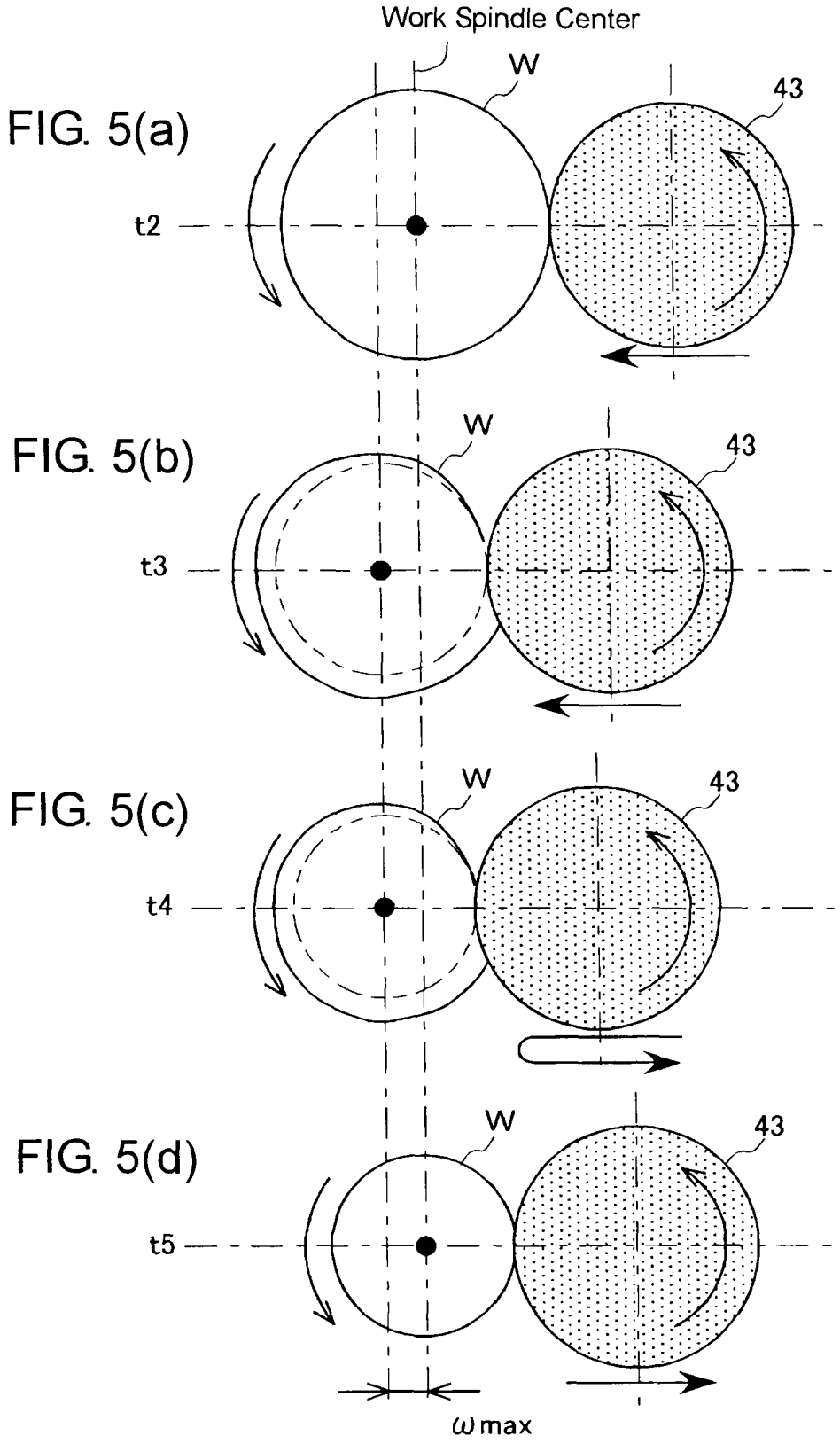
FIGS. 5(*a*)-5(*d*) are explanatory views for showing the positions of a workpiece and a grinding wheel at respective times t2-t5 in FIG. 3 in the first embodiment, wherein FIG. 5(*a*) shows the state at time t2 in FIG. 3, FIG. 5(*b*) shows the state at time t3 in FIG. 3, FIG. 5(*c*) shows the state at time t4 and FIG. 5(*d*) shows the state at time t5 in FIG. 3.

Next, a grinding method in the first embodiment will be described with reference to FIGS. 2 to 6. Referring now to FIG. 2 showing a grinding control program executed by the controller 70 in this embodiment, first of all, there is started a first advance grinding (S1). The first advance grinding corresponds to a time period from time t1 to time t4 shown in FIG. 3. That is, as indicated by the bending amount ω in FIG. 3 and as shown in FIGS. 5(*a*) and 5(*b*), the first advance grinding is a grinding operation which is performed by moving the grinding wheel 43 in a first direction to press the same against the workpiece W with the bending amount ω of the workpiece W increasing (i.e., to increase the bending amount ω). Specifically, as the wheel head position is indicated in FIG. 3, the wheel head 42 is moved at a fixed feed rate in the X-axis direction and in such a direction as to be pressed against the workpiece W.

Figure 3:
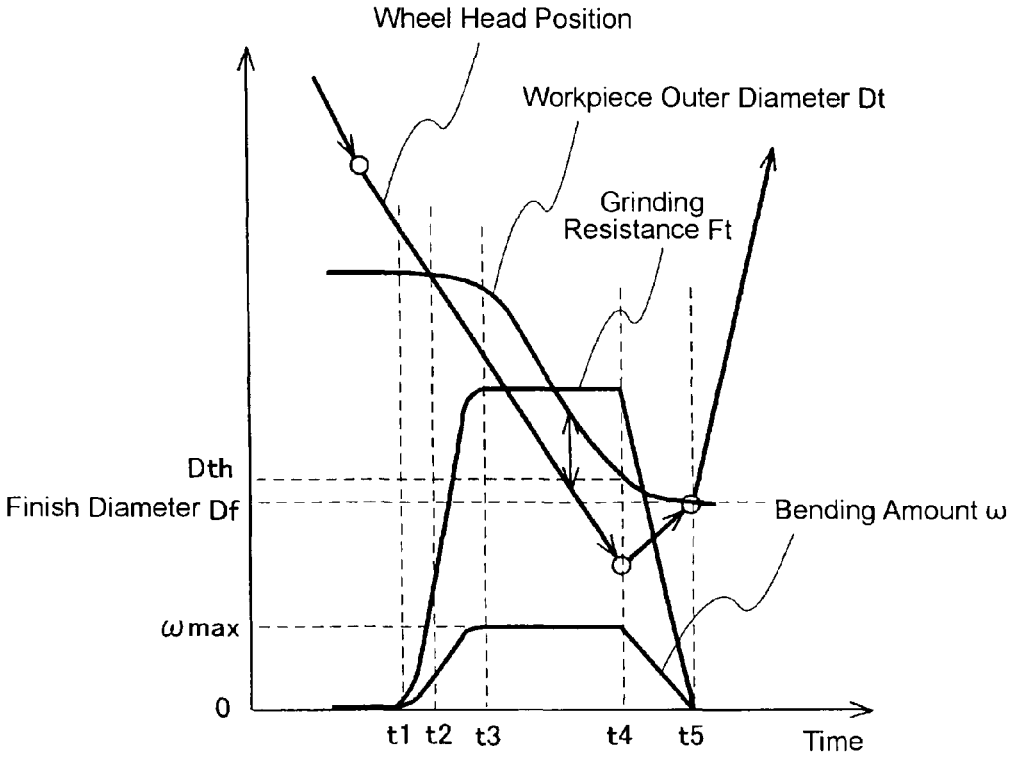
FIG. 3 is a graph showing wheel head position, workpiece outer diameter Dt, grinding resistance Ft and bending amount ω with the lapse of time in the first embodiment.

Then, at time t1 in FIG. 3, the grinding wheel 43 has not contacted the workpiece W yet. As the wheel head 42 is further moved toward the workpiece W, the grinding wheel 43 comes to contact the workpiece W at time t2 in FIG. 3 as indicated by the wheel head position and the workpiece outer diameter Dt in FIG. 3 and as shown in FIG. 5(*a*). At this time, the rotational center of the workpiece W is in agreement with the work spindle center.

Then, for the period from time t2 to time 3 in FIG. 3, the grinding resistance Ft detected by the force sensor 50 increases abruptly. At the same time, the bending amount ω of the workpiece W also increases. The bending amount ω of the workpiece W corresponds to the difference between the workpiece outer diameter Dt detected by the sizing device 60 and the wheel head position as indicated in FIG. 3. As indicated by the bending amount ω of the workpiece W and the grinding resistance Ft in FIG. 3, the grinding resistance Ft and the bending amount ω of the workpiece W is in a proportional relation (i.e., in proportion to each other). Therefore, at time t3 in FIG. 3, as shown in FIG. 5(*b*), the rotational center of the workpiece W at the grinding position resides at a position where it deviates by a bending amount ωmax from the work spindle center. Herein, the state that in the first advance grinding, the grinding resistance Ft is changing, that is, the period from time t2 to time t3 is referred to as transition state.

Subsequently, for the period from time t3 to time t4 in FIG. 3, the grinding resistance Ft detected by the force sensor 50 becomes constant (i.e., stable). At the same time, the bending amount ω of the workpiece W also becomes constant. The bending amount ω of the workpiece W corresponds to the difference between the workpiece outer diameter Dt detected by the sizing device 60 and the wheel head position which are indicated in FIG. 3. That is, the grinding resistance Ft and the wheel head position are held in parallel for the period from time t3 to time t4 in FIG. 3. During this period, as shown in FIGS. 5(*b*) and 5(*c*), the rotational center of the workpiece W at the grinding position resides at a position where it deviates by the bending amount ωmax from the work spindle center. Herein, the state that in the first advance grinding, the grinding resistance Ft becomes constant or stable, that is, the period from time t3 to time t4 in FIG. 3 is referred to as stationary state.

Thereafter, a judgment is made as to whether or not the outer diameter Dt of the workpiece W has reached a predetermined outer diameter Dth (S2). If the outer diameter Dt of the workpiece W has not yet reached the set value Dth (S2: N), the first advance grinding is continued. When the outer diameter Dt of the workpiece W has reached the set value Dth (S2: Y), on the contrary, the first advance grinding is completed (S3).

Then, a retraction grinding is started (S4). That is, the switching from the first advance grinding to the retraction grinding is made when the outer diameter Dt of the workpiece W reaches the set value Dth. The retraction grinding referred to herein means a grinding operation which is carried out as the bending amount ω of the workpiece W is decreased by relatively moving the grinding wheel 43 in a second direction to go away from the workpiece W.

Figure 6A:
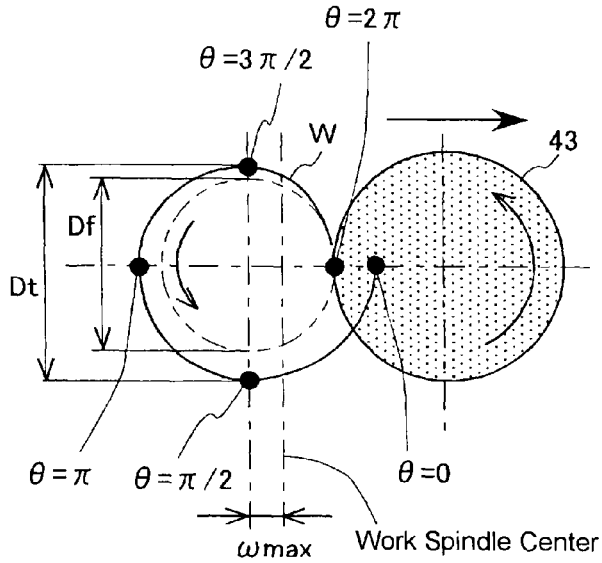
FIG. 6(*a*) is an enlarged view of the state shown in FIG. 5(*c*), and FIG. 6(*b*) is a graph showing the relations of residual grinding amount E(θ) and target grinding resistance Fe(θ) relative to the rotational phase θ of the workpiece in the first embodiment.
Figure 6B:
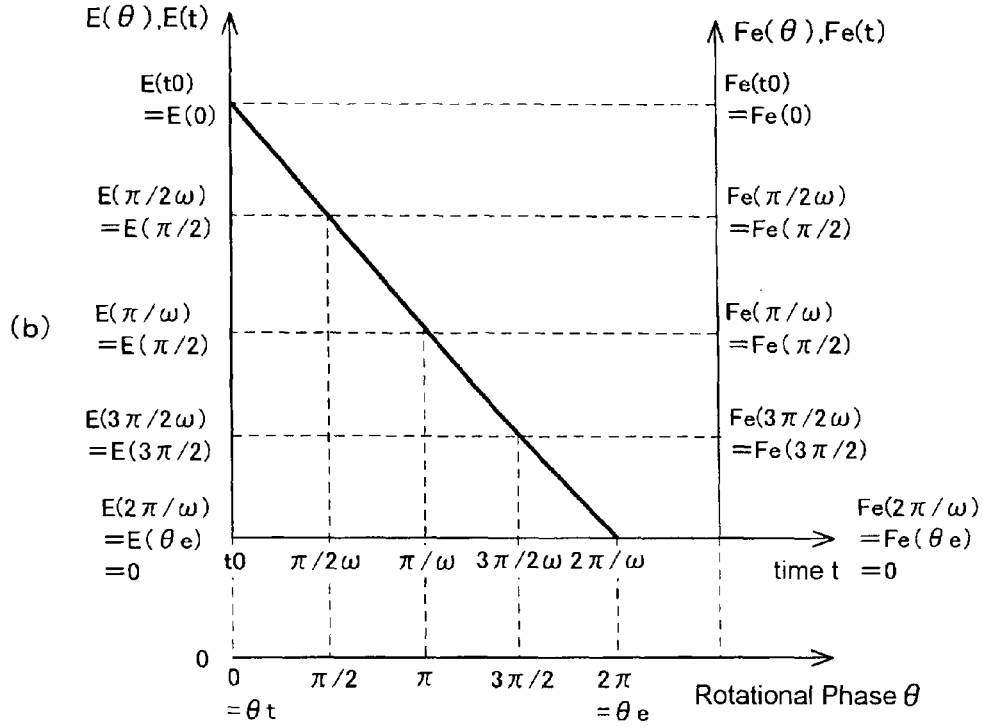

The retraction grinding will be described with reference to FIGS. 6(*a*) and 6(*b*). FIG. 6(*a*) shows the workpiece W and the grinding wheel 43 in the state that the first advance grinding has just been completed. As shown in FIG. 6(*a*), it can be understood that the workpiece W has residual grinding amounts E(θ) which differ in dependence on respective rotational phases θ, relative to a finish diameter Df. Specifically, as shown in FIGS. 6(*a*) and 6(*b*), where the rotational phase θ of the workpiece W is 0 degree (corresponding to "present rotational phase θt" in the claimed invention), the residual grinding amount is E(0). The target grinding resistance at this rotational phase is set to Fe(0). Since the residual grinding amount becomes ¾×E(0) when the rotational phase θ of the workpiece W reaches π/2 degrees, the target grinding resistance at this rotational phase is set to ¾×Fe(0).

Since the residual grinding amount becomes ½×E(0) when the rotational phase θ of the workpiece W reaches π degrees, the target grinding resistance at this rotational phase is set to ½×Fe(0). Since the residual grinding amount becomes ¼×E(0) when the rotational phase θ of the workpiece W reaches 3π/4 degrees, the target grinding resistance at this rotational phase is set to ¼×Fe(0). Finally, since the residual grinding amount becomes zero when the rotational phase θ of the workpiece W reaches 2π degrees (corresponding to "target rotational phase θe" in the claimed invention), the target grinding resistance Fe(θe) at this rotational phase is set to zero. In the present embodiment, the residual grinding amount E(θ) is assumed to has a linear relation relative to the rotational phase θ of the workpiece W at the completion time t4 of the first advance grinding.

As shown in FIGS. 6(*a*) and 6(*b*), the retraction grinding in the present embodiment is designed to be performed only during one rotation of the workpiece W. That is, as shown in FIG. 3, the workpiece W is to be rotated one turn or rotation for the period from a starting time t4 to a completion time t5*b* of the retraction grinding. Thus, the grinding resistance Ft is set to become zero at the completion time t5 of the retraction grinding. That the grinding resistance Ft becomes zero at time t5 means that as shown in FIG. 5(*d*), the rotational center of the workpiece W comes to agreement with the work spindle center.

Next, the control operation in the retraction grinding will be described with reference to a control block diagram shown in FIG. 4. As shown in FIG. 4, a feedback control on the basis of the grinding resistance Ft is carried out in the retraction grinding. Specifically, for the period during which the workpiece W rotates from the present rotational phase θt to the target rotational phase θe, a target grinding resistance generation section 201 generates target grinding resistances Fe(θ) in the respective rotational phases θ based on the residual grinding amounts E(θ) in the respective rotational phases θ. In the present embodiment, the target grinding resistance Fe(θ) is set to become linear and to become zero at time t5, as indicated in FIG. 6(*b*) and as indicated by the grinding resistance Ft for the period from time t4 to time 5 in FIG. 3.

A grinding resistance detection section 202 corresponds to the force sensor 50 and detects the grinding resistance Ft. An adder 203 adds the grinding resistance Ft detected by the grinding resistance detection section 202 to the target grinding resistance Fe(θ) generated by the target grinding resistance generation section 201. Then, based on the resistance which is calculated by the adder 203, a wheel head path generation section 204 generates the path in the X-axis direction of the wheel head 42. Then, the X-axis motor 205 (corresponding to the motor 41*d* in FIG. 1) is driven based on the generated path in the X-axis direction of the wheel head 42. In this way, in the retraction grinding, the feedback control is carried out to make the grinding resistance Ft agree with the target grinding resistance Fe(θ). Those components encircled by the two-dot-chain line in FIG. 4 are configured as software or hardware function means incorporated in the controller 70.

Turning now back to FIG. 2, description will be continued. Description has been completed up to the stage that the retraction grinding is to begin at step S4 in FIG. 2. Following this stage, a judgment is made as to whether or not the grinding resistance Ft has reached zero (S5). If the grinding resistance Ft has not reached zero yet (S5: N), the retraction grinding is continued. If the grinding resistance Ft has reached zero (S5: Y), on the contrary, the retraction grinding is completed (S6), and the processing for the grinding method is ended. That is, it is understood that the outer diameter Dt of the workpiece W reaches the finish diameter Df at time t5 in FIG. 3 when the retraction grinding is completed.

According to the present embodiment, it is possible to shorten the grinding period of time remarkably. In particular, it is possible to perform the first advance grinding as rough grinding and to perform the retraction grinding as finish grinding. Further, in the retraction grinding, a precise grinding becomes possible by utilizing the grinding resistance as mentioned earlier.

(Modified Form of First Embodiment)

Figure 7:
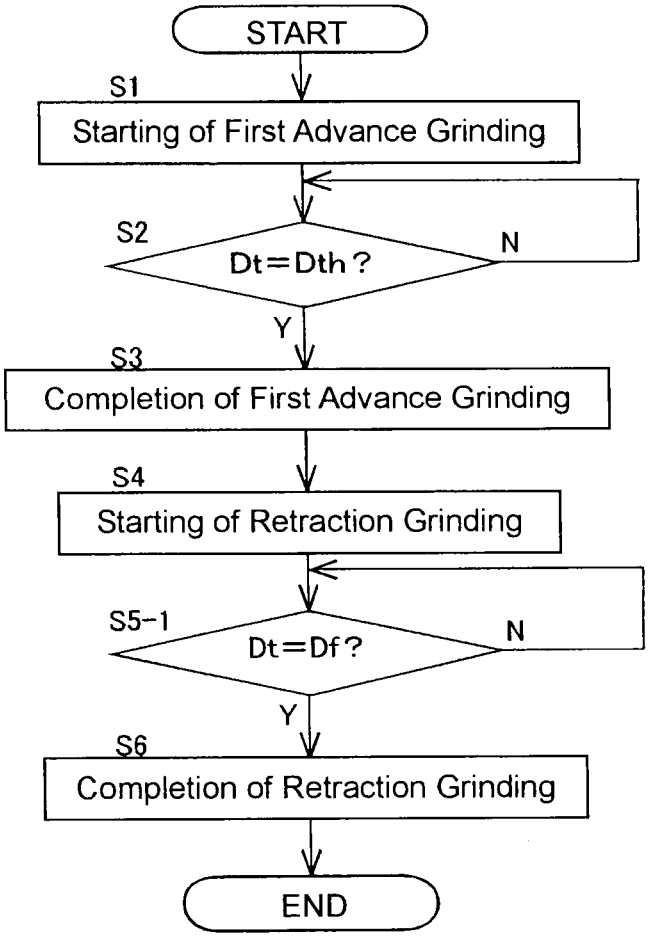
FIG. 7 is a flowchart showing a grinding method in a modified form of the first embodiment.

In the foregoing first embodiment, as shown at step S5 in FIG. 2, the judgment as to the completion of the retraction grinding is made in dependence on whether the grinding resistance Ft has reached zero or not. Alternatively, as shown in FIG. 7, the retraction grinding may be completed when the outer diameter Dt of the workpiece W detected by the sizing device 60 reaches the predetermined finish diameter Df. That is, at step S5-1 in FIG. 7, a judgment is made as to whether or not the outer diameter Dt of the workpiece W detected by the sizing device 60 has reached the finish diameter Df, and if the outer diameter Dt of the workpiece W has reached the finish diameter Df (S5-1: Y), the retraction grinding is completed. Other steps except for the step S5-1 in FIG. 7 are the same as those in FIG. 2, and therefore, description of the other steps will be omitted for the sake of brevity.

(Second Embodiment)

A grinding method in a second embodiment will be described with reference to FIGS. 1, 8 and 9. The grinding method practiced on the grinding machine in the second embodiment is a method of performing a first advance grinding, then performing a retraction grinding and finally performing a spark-out grinding. In the first advance grinding, a position control is executed to keep the feed rate of the wheel head 42 constant. In the retraction control, a feedback control is executed to make grinding resistance follow or agree with the target grinding resistance Fe. Further, in the spark-out grinding, the grinding allowance is set to zero.

Figure 8:
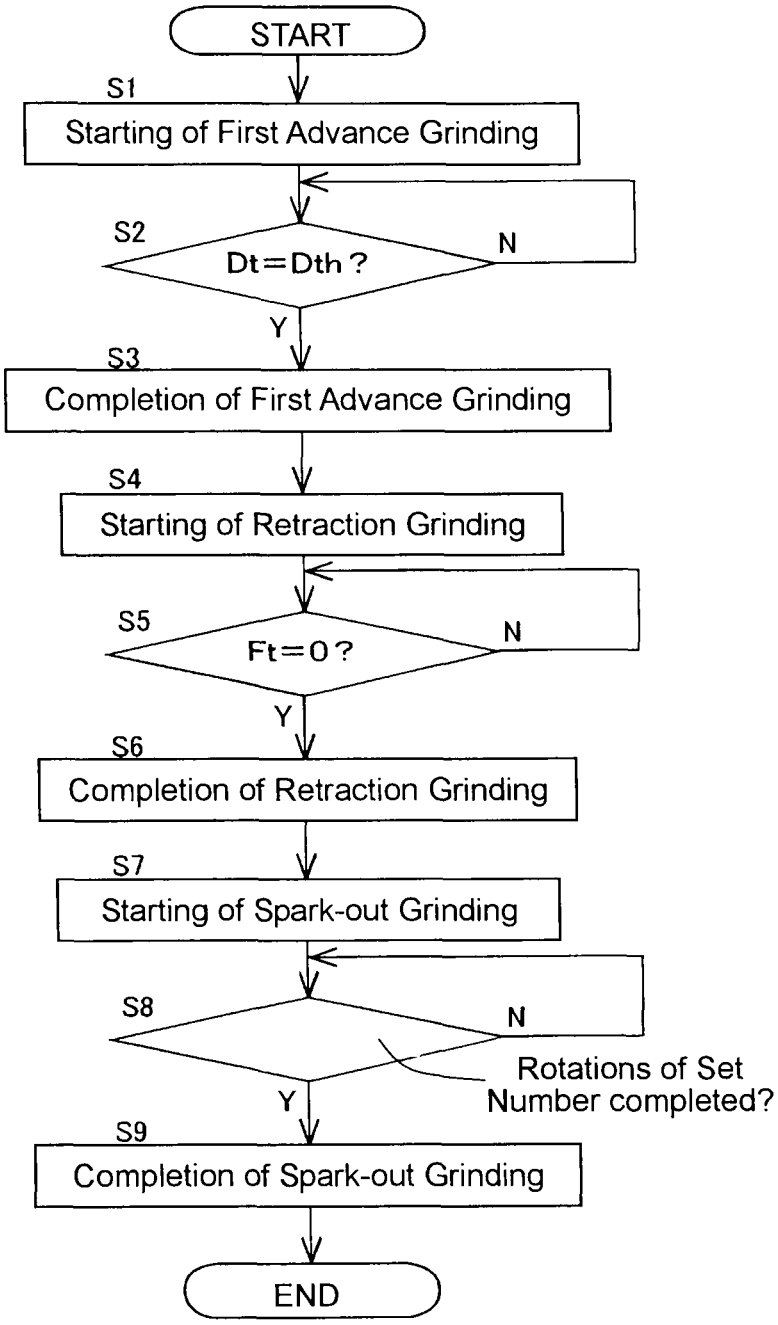
FIG. 8 is a flowchart showing a grinding method practiced on the grinding machine in a second embodiment.

In FIG. 8 showing a grinding control program executed by the controller 70 in the second embodiment, steps S1 through S6 are the same as those in FIG. 2 which shows the grinding method in the first embodiment. When the retraction grinding is completed at step S6, the spark-out grinding is performed (S7). The spark-out grinding is carried out with an infeed amount of the grinding wheel 43 against the workpiece W held zero. The spark-out grinding is carried out only for the period in which the workpiece W is turned a predetermined number of times. A judgment is made as to whether or not the workpiece W has rotated through a predetermined number of turns (S8), and when the rotation has been performed through the predetermined number of turns, the spark-out grinding is completed (S9).

Figure 9:
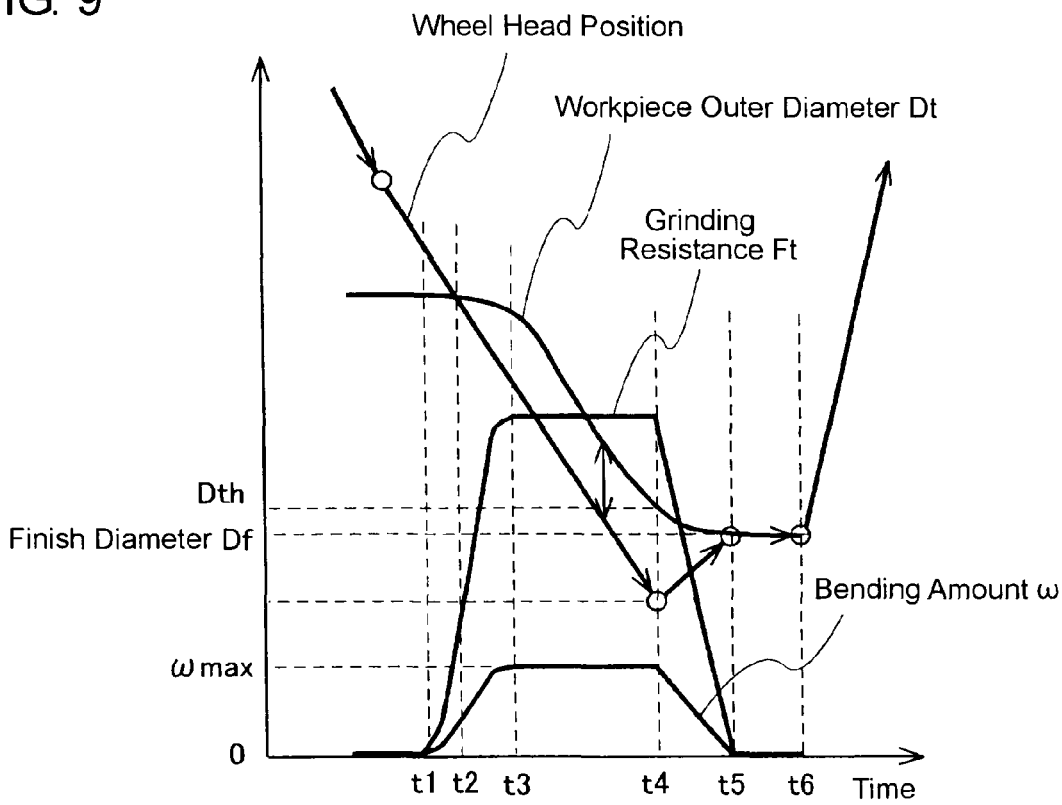
FIG. 9 is a graph showing wheel head position, workpiece outer diameter Dt, grinding resistance Ft and bending amount ω with the lapse of time in the second embodiment.

FIG. 9 shows the wheel head position, the workpiece outer diameter Dt, the grinding resistance Ft, the bending amount ω with the lapse of time in the second embodiment. That is, the spark-out grinding is performed for the period from time t5 to time t6. The period from time t1 through time t5 is the same as that in the first embodiment.

It may be the case that in the first advance grinding and the retraction grinding, the machining accuracy on the ground surface fluctuates due to various causes. However, by performing the spark-out grinding in the second embodiment, it is possible to suppress the fluctuation. As a result, the surface properties on the ground surface of the cylindrical workpiece W can be improved remarkably.

(First Modified Form of Second Embodiment)

In the foregoing second embodiment, as shown at step S5 in FIG. 8, the judgment as to the completion of the retraction grinding is made in dependence on whether or not the grinding resistance Ft has reached zero. Instead, the retraction grinding may be completed when the outer diameter Dt of the workpiece W detected by the sizing device 60 reaches the predetermined finish diameter Df. That is, the step S5 in FIG. 8 is modified so that a judgment is made as to whether or not the outer diameter Dt of the workpiece W detected by the sizing device 60 has reached the predetermined finish diameter Df, and that if the outer diameter Dt of the workpiece W has reached the finish diameter Df (S5: Y), the retraction grinding is completed. Subsequently, the spark-out grinding follows. This modified form achieves substantially the same effects as those in the foregoing second embodiment.

(Second Modified Form of Second Embodiment)

Further, in the foregoing second embodiment, as shown at step S8 in FIG. 8, the judgment as to the completion of the spark-out grinding is made in dependence on whether or not the workpiece has rotated through the predetermined number of turns in the spark-out grinding. Instead, the spark-out grinding may be completed when the outer diameter Dt of the workpiece W detected by the sizing device 60 has reached the predetermined finish diameter Df. That is, the step S8 in FIG. 8 is modified so that a judgment is made as to whether or not the outer diameter Dt of the workpiece W detected by the sizing device 60 has reached the finish diameter Df, and that if the outer diameter Dt of the workpiece W has reached the finish diameter Df (S8: Y), the spark-out grinding is completed. This modification is applicable to the case wherein the completion of the retraction grinding is judged in dependence on whether or not the grinding resistance Ft has reached zero.

(Third Embodiment)

A grinding method in a third embodiment will be described with reference to FIGS. 1 and 10 through 13. The grinding method practiced on the grinding machine in the third embodiment is a method of performing a first advance grinding, then performing a retraction grinding and finally performing a spark-out grinding. In the first advance grinding, a position control is executed to keep the feed rate of the wheel head 42 constant. In the retraction grinding, a feedback control is executed to make the grinding resistance Ft follow or agree with a target grinding resistance Fe. The completion time of the retraction grinding is determined to be the time at which the grinding resistance Ft reaches (i.e., is reduced to) a resistance component (hereafter referred to as "dynamic pressure effect equivalent value") Fϵ1 which is brought about by the influence of a dynamic pressure generated in coolant fluid. Further, the starting position of the spark-out grinding is determined taking the dynamic pressure effect equivalent value Fϵ1 into consideration.

Figure 10:
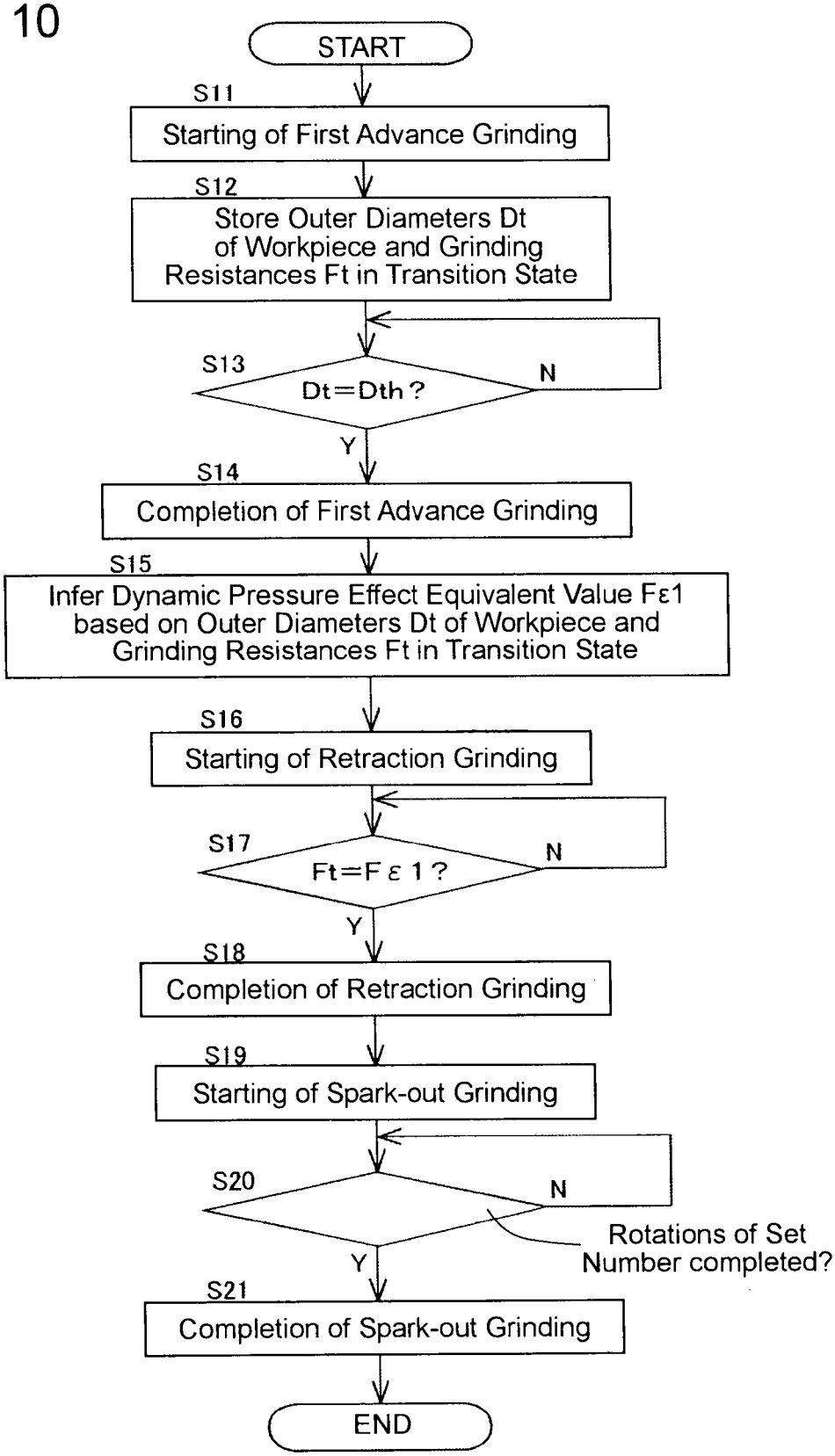
FIG. 10 is a flowchart showing a grinding method practiced on the grinding machine in a third embodiment.
Figure 11:
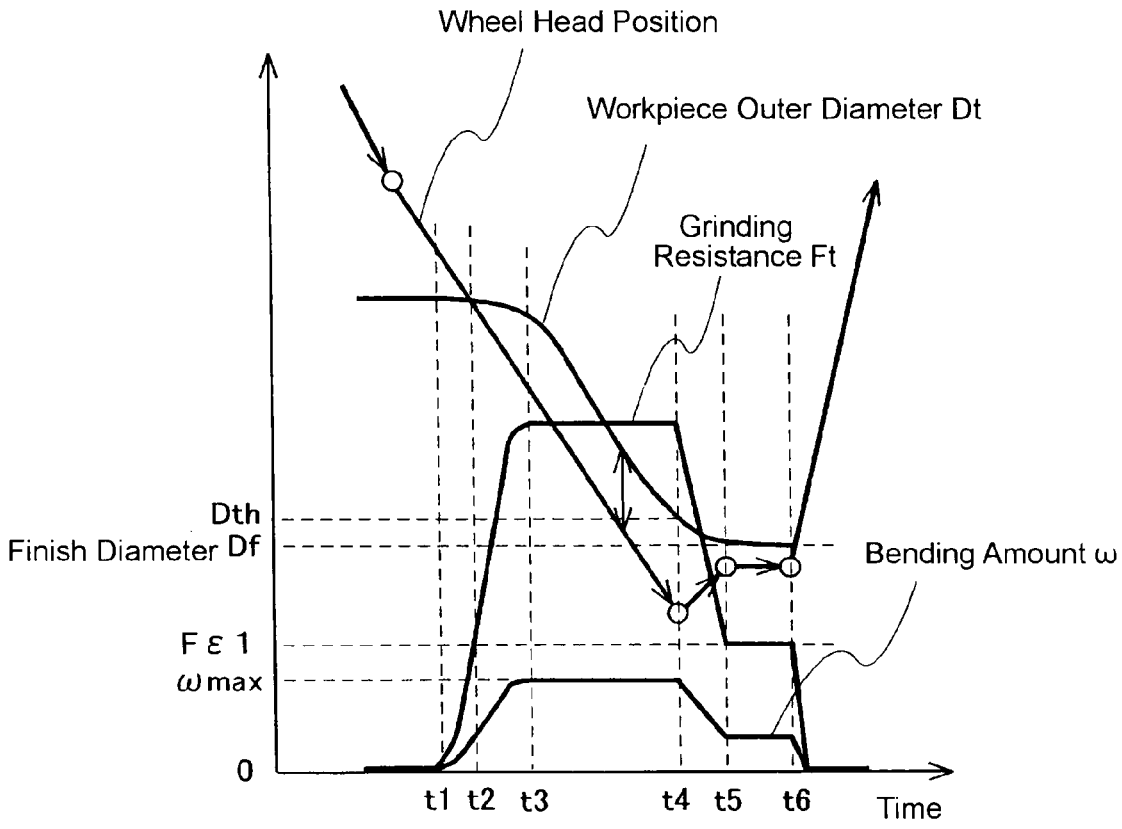
FIG. 11 is a graph showing wheel head position, workpiece outer diameter Dt, grinding resistance Ft and bending amount ω with the lapse of time in the third embodiment.

As shown in FIG. 10 showing a grinding control program executed by the controller 70 in the third embodiment, the first advance grinding is started (S11). The first advance grinding corresponds to the period from time t1 to time t4 in FIG. 11. The processing during this period is the same as that in the foregoing first embodiment and therefore, is excluded from being described in detail for the sake of brevity.

Then, a plurality of the outer diameters Dt of the workpiece W and the grinding resistances Ft are stored in a transition state (from time t2 to time t3) (S12). Then, a judgment is made as to whether or not the outer diameter Dt of the workpiece W has reached the predetermined set value Dth (S13). If the outer diameter Dt of the workpiece W has not yet reached the set value Dth (S13: N), the first advance grinding is continued. If the outer diameter Dt of the workpiece W has reached the set value Dth (S13: Y), the first advance grinding is completed (S14).

Figure 12:
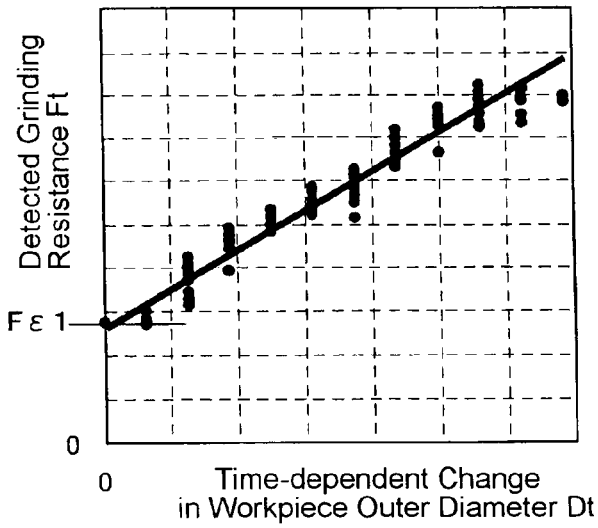
FIG. 12 is a graph used in inferring dynamic pressure effect equivalent value Fϵ1 in the third embodiment, showing the relation of grinding resistance Ft relative to decrease amount in workpiece outer diameter.

Then, the value Fϵ1 equivalent to the dynamic pressure effect brought about by coolant fluid is inferred based on the diameters Dt of the workpiece W and the grinding resistances Ft in the transition state gathered and stored at step S12 (S15). FIG. 12 shows the relation between the decrease amount in the outer diameter Dt of the workpiece W and the grinding resistance Ft in the transition state. By linearly approximating the gathered points, it is possible to represent the plurality of the gathered points as a linear line shown in FIG. 12. In this approximated linear line, the point at which the decrease amount in the outer diameter Dt of the workpiece W becomes zero is inferred as the dynamic pressure effect equivalent value F$\epsilon$1 caused by coolant fluid.

Then, the retraction grinding is started (S16). That is, when the outer diameter Dt of the workpiece W reaches the set value Dth, a switching is made from the first advance grinding to the retraction grinding. Then, a judgment is made as to whether or not the grinding resistance Ft has reached the dynamic pressure effect equivalent value F$\epsilon$1 (S17). If the grinding resistance Ft has not yet reached the dynamic pressure effect equivalent value F$\epsilon$1 (S17: N), the retraction grinding is continued. If the grinding resistance Ft has reached the dynamic pressure effect equivalent value F$\epsilon$1 (S17: Y), on the contrary, the retraction grinding is completed (S18). That is, the target grinding resistance Fe(θ) is set so that the grinding resistance Ft comes to agreement with the dynamic pressure effect equivalent value F$\epsilon$1 when the retraction grinding is completed (i.e., when a target rotational phase θe is reached).

Upon completion of the retraction grinding, the spark-out grinding is carried out (S19). The spark-out grinding is carried out with the infeed amount of the grinding wheel 43 against the workpiece W held zero. That is, at the starting time t5 of the spark-out grinding, the position of the wheel head 42 is at the position that deviates by a dimension corresponding to the dynamic pressure effect equivalent value F$\epsilon$1 from a position where it is to be with the workpiece W ground to the finish diameter Df. The spark-out grinding is carried out only during the period for the workpiece W to turn a predetermined number of times. Thus, it is judged whether or not the workpiece W has turned by the predetermined number of times (S20), and if it has turned the predetermined number of times, the spark-out grinding is completed (S21).

Figure 13:
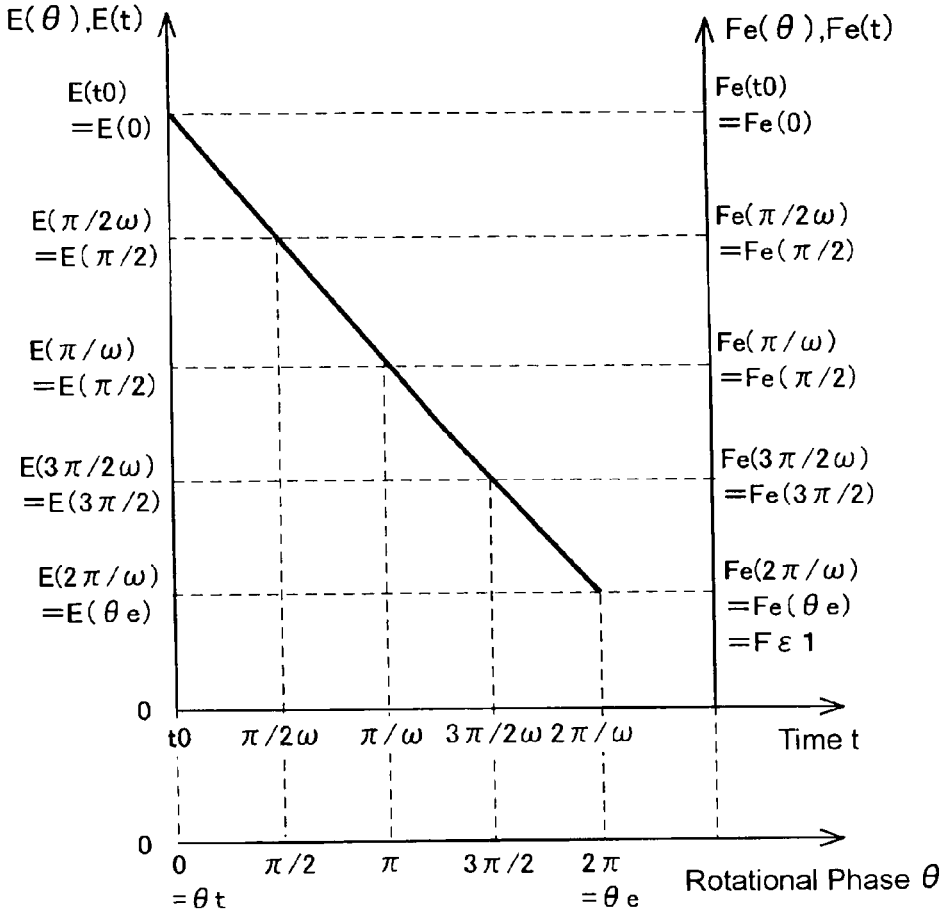
FIG. 13 is a graph showing the relations of residual grinding amount E(θ) and target grinding resistance Fe(θ) relative to the rotational phase θ of the workpiece in the third embodiment.

Now, the retraction grinding in this embodiment will be described with reference to FIG. 13. As shown in FIG. 13, when the rotational phase θ of the workpiece W is 0 degree (corresponding to "present rotational phase θt" in the claimed invention), the residual grinding amount becomes E(0). The target grinding resistance in this phase is set to Fe(0). Further, when the rotational phase θ of the workpiece W is 2π degrees (corresponding to "target rotational phase θe" in the claimed invention), the target grinding resistance Fe(θe) is set to become the dynamic pressure effect equivalent value F$\epsilon$1. The residual grinding amount in this phase becomes E(θe). When the rotational phase θ of the workpiece W is π degrees, the residual grinding amount becomes ½×(E(0)+E(θe)), the target grinding resistance is set to ½×(Fe(0)+Fe(θe)).

According to the present embodiment, it is possible to perform the feedback control which is reliably on the basis of the grinding resistance, in consideration of the influence of a dynamic pressure caused by coolant fluid. While the workpiece W is being ground with the grinding wheel 43, a resistance component which is generated by the influence of the dynamic pressure caused by coolant fluid causes the resistance arising on the workpiece W to become larger than the grinding resistance (i.e., the resistance developed by the physical contact between the workpiece W and the grinding wheel 43). Further, even when the grinding wheel 34 and the workpiece W are out of contact, a resistance arises on the workpiece due to the influence of a dynamic pressure caused by coolant fluid if the separation distance therebetween is very little. That is, because a resistance component brought about by the influence of the dynamic pressure in coolant fluid causes the workpiece W to be bent, it is likely that a grinding remainder arises even if the grinding resistance Ft becomes zero. Therefore, by setting the target grinding resistance Fe(θ) so that the grinding resistance Ft becomes the dynamic pressure effect equivalent value F$\epsilon$1 when the target rotational phase θe is reached (i.e., when the retraction grinding is completed), it becomes possible to reliably exclude the influence of the dynamic pressure caused by coolant fluid, so that a precise grinding can be realized.

(First Modified Form of Third Embodiment)

In the foregoing third embodiment, as shown at step S17 in FIG. 10, the completion of the retraction grinding is judged in dependence on whether or not the grinding resistance Ft has reached the dynamic pressure effect equivalent value F$\epsilon$1. Instead, the completion of the retraction grinding may be judged when the outer diameter Dt detected by the sizing device 60 reaches the set finish diameter Df. That is, the step S17 in FIG. 10 may be modified so that the outer diameter Dt detected by the sizing device 60 is judged as to whether or not it has reached the set finish diameter Df, and that if it has reached the finish diameter Df (S17: Y), the retraction grinding is completed.

(Second Modified Form of Third Embodiment)

Further, in the foregoing third embodiment, as shown at step S20 in FIG. 10, the completion of the spark-out grinding is judged in dependence on whether or not the workpiece W has turned the predetermined number of times during that grinding. Instead, the spark-out grinding may be completed when the outer diameter Dt of the workpiece W detected by the sizing device 60 reaches the set finish diameter Df. That is, the step 20 in FIG. 10 may be modified so that the outer diameter Dt of the workpiece W detected by the sizing device 60 is judged as to whether or not it has reached the set finish diameter Df, and that if it has reached the set finish diameter Df (S20: Y), the spark-out grinding is completed. This modification is applied in the case that the judgment as to whether the retraction grinding has been completed or not is executed in dependence on whether or not the grinding resistance Ft has reached the dynamic pressure effect equivalent value F$\epsilon$1.

(Fourth Embodiment)

A grinding method in a fourth embodiment will be described with reference to FIGS. 1 and 14 through 16. The grinding method practiced on the grinding machine in the fourth embodiment is a method of performing a first advance grinding, then performing a retraction grinding and finally performing a spark-out grinding. In the first advance grinding, a position control is performed to make the feed rate of the wheel head 42 constant. In the retraction grinding, a feedback control is performed to make the grinding resistance Ft follow or agree with a target grinding resistance F$\epsilon$2. Further, it is designed to leave a grinding allowance R$\epsilon$1 over the whole circumference of the workpiece W at the completion time of each of the first advance grinding and the retraction grinding. That is, the spark-out grinding is to grind the residual grinding allowance R$\epsilon$1.

Figure 14:
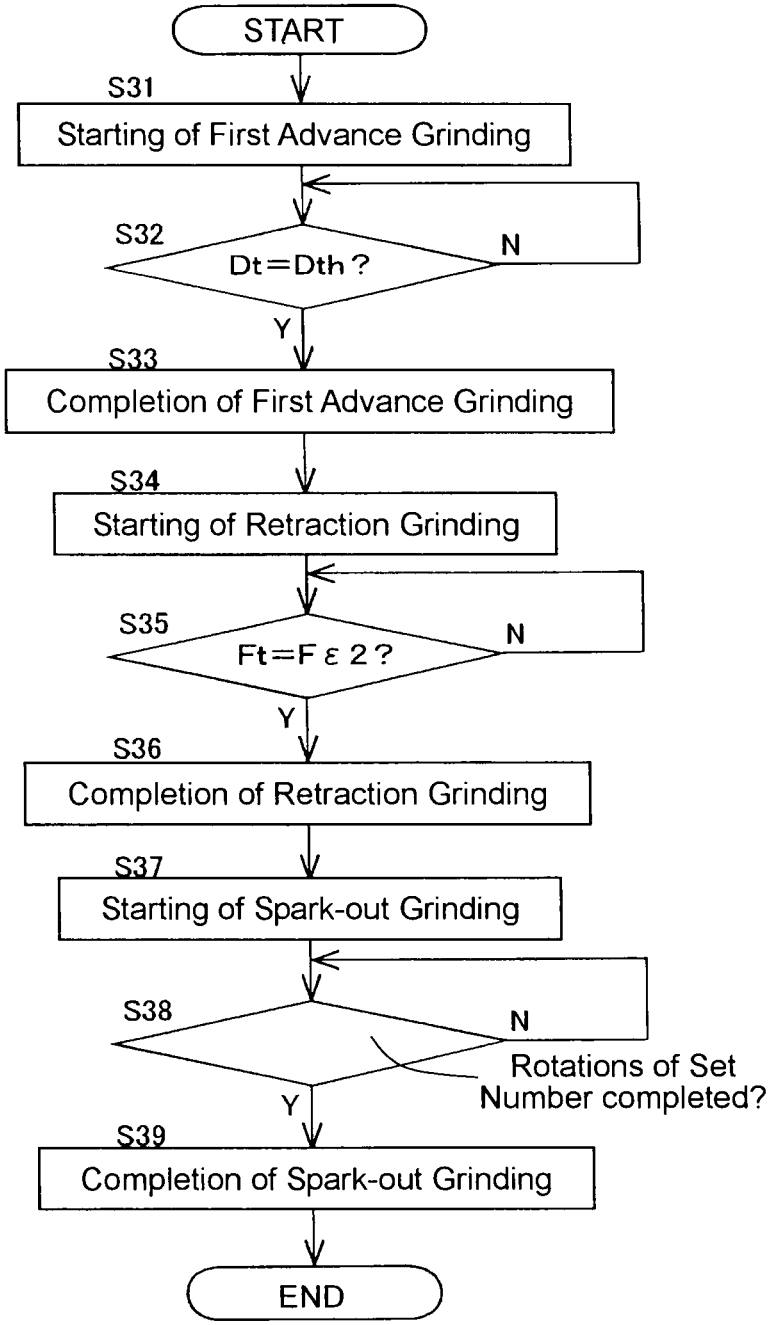
FIG. 14 is a flowchart showing a grinding method practiced on the grinding machine in a fourth embodiment.

As shown in FIG. 14 showing a grinding control program executed by the controller 70 in the fourth embodiment, the first advance grinding is started (S31). The first advance grinding corresponds to the period from time t1 to time t4 in FIG. 15. This time period is the same as that in the foregoing first embodiment and therefore, will be excluded from being described in detail. Then, a judgment is made as to whether or not the outer diameter Dt of the workpiece W has reached the predetermined value Dth (S32). In this particular embodiment, the set outer diameter Dth is represented by expression Df−ωmax+R$\epsilon$1. That is, at the completion time of the first advance grinding (i.e., at time t4 in FIG. 15), it results that the grinding allowance R$\epsilon$1 only is left without being ground over the whole circumference of the workpiece W.

Then, unless the outer diameter Dt of the workpiece W has reached the set value Dth (S32: N), the first advance grinding is continued. If the outer diameter Dt of the workpiece W has reached the set value Dth (S32: Y), on the contrary, the first advance grinding is completed (S33).

Then, the retraction grinding is started (S34). That is, when the outer diameter Dt of the workpiece W reaches the set value Dth, a switching is made from the first advance grinding to the retraction grinding. Then, it is judged whether or not the grinding resistance Ft has reached a set value Fϵ2 (S35). The set value Fϵ2 represents the grinding resistance Ft in the state that the outer diameter Dt of the workpiece W reaches the set value Dth. That is, the target grinding resistance Fe(θ) is set so that the grinding resistance Ft comes to agreement with the set value Fϵ2 at the completion time of the retraction grinding (i.e., when the target rotational phase θe is reached).

Thereafter, unless the grinding resistance Ft has reached the set value Fϵ2 (S35: N), the retraction grinding is continued. If the grinding resistance Ft has reached the set value Fϵ2 (S35: Y), on the contrary, the retraction grinding is completed (S36). At this time, the outer diameter Dt of the workpiece W becomes Df1 (=Df+Rϵ1).

Figure 16:
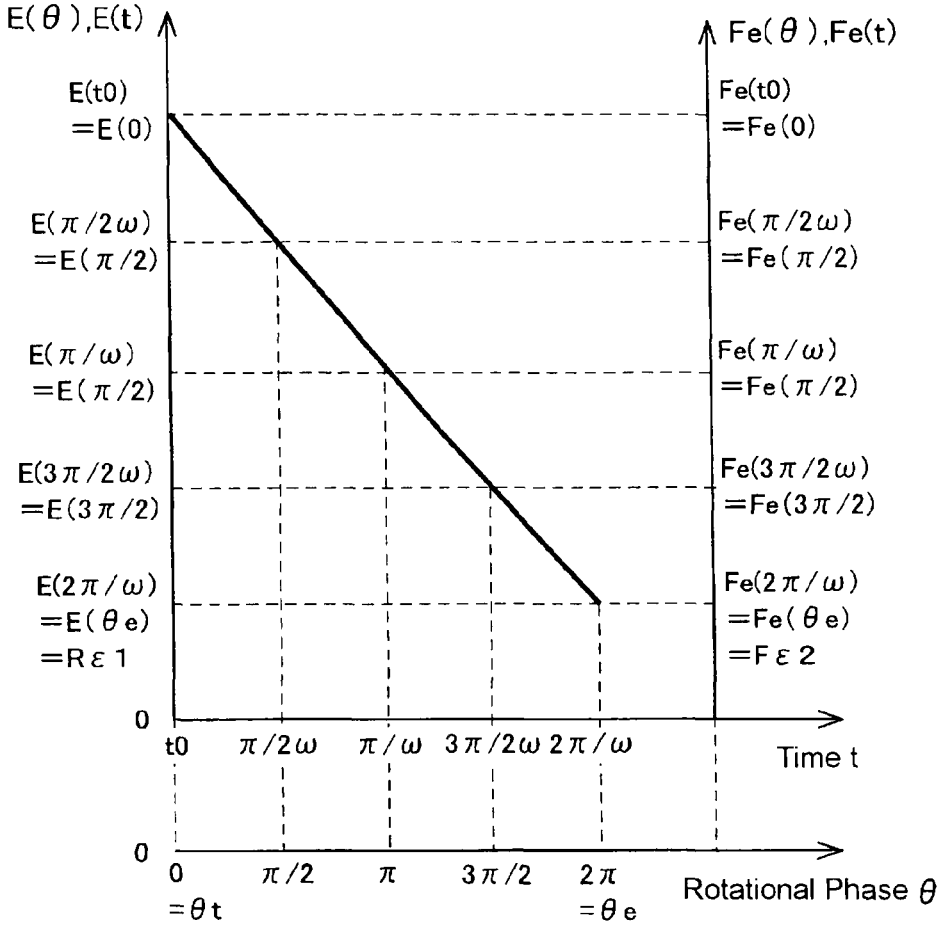
FIG. 16 is a graph showing the relations of residual grinding amount E(θ) and target grinding resistance Fe(θ) relative to the rotational phase θ of the workpiece in the fourth embodiment.

Now, the retraction grinding in this embodiment will be described with reference to FIG. 16. As shown in FIG. 16, when the rotational phase θ of the workpiece W is 0 degree (corresponding to "present rotational phase θt" in the claimed invention), the residual grinding amount becomes E(0). The target grinding resistance in this phase is set to Fe(0). Further, when the rotational phase θ of the workpiece W is 2π degrees (corresponding to "target rotational phase θe" in the claimed invention), the residual grinding amount E(θe) is designed to come to agreement with the grinding allowance Rϵ1. At this time, the target grinding resistance Fe(θe) is set to come to agreement with the Fϵ2 corresponding to the grinding allowance Rϵ1. When the rotational phase θ of the workpiece W is π degrees, the residual grinding amount becomes ½×(E(0)+E(θe)), and the target grinding resistance is set to ½×(Fe(0)+Fe(θe)).

Turning now back to FIG. 14, the spark-out grinding is performed (S37) following the completion of the retraction grinding. The spark-out grinding is carried out with the infeed amount of the grinding wheel 43 against the workpiece W held zero. That is, the spark-out grinding results in grinding the grinding allowance Rϵ1. The spark-out grinding is carried out only during the period for the workpiece W to turn a predetermined number of times. Thus, it is judged whether or not the workpiece W has turned by the predetermined number of times (S38), and if it has turned the predetermined number of times, the spark-out grinding is completed (S39).

According to the present embodiment, it is designed that the residual grinding allowance becomes Rϵ1 when the target rotational phase θe is reached. Therefore, the residual grinding allowance becomes the predetermined value Rϵ1 when the retraction grinding is completed. Then, the predetermined value Rϵ1 left without being ground can be ground in the spark-out grinding, and hence, it is possible to obtain a precise shape upon completion of the spark-out grinding.

(First Modified Form of Fourth Embodiment)

In the foregoing fourth embodiment, as shown at step S35 in FIG. 14, the completion of the retraction grinding is judged in dependence on whether or not the grinding resistance Ft has reached the set value Fϵ2. Alternatively, the retraction grinding may be completed when the outer diameter Dt of the workpiece W detected by the sizing device 60 reaches a diameter Df1 (=Df+Rϵ1) with the allowance Rϵ1 remaining. That is, the step S35 in FIG. 14 may be modified so that a judgment is made as to whether or not the outer diameter Dt of the workpiece W detected by the sizing device 60 has reached the set value Df1 and that if the outer diameter Dt of the workpiece W has reached the set value Df1 (S35: Y), the retraction grinding is completed. Further, the spark-out grinding is performed thereafter. In this modified form, substantially the same effects as those in the foregoing second embodiment are accomplished.

(Second Modified Form of Fourth Embodiment)

Further, in the foregoing fourth embodiment, as shown at step S38 in FIG. 14, the completion of the spark-out grinding is judged in dependence on whether or not the workpiece W has turned the predetermined number of times during that grinding. Instead, the spark-out grinding may be completed when the outer diameter Dt of the workpiece W detected by the sizing device 60 reaches the set finish diameter Df. That is, the step 38 in FIG. 14 may be modified so that the outer diameter Dt of the workpiece W detected by the sizing device 60 is judged as to whether or not it has reached the set finish diameter Df, and that if it has reached the set finish diameter Df (S38: Y), the spark-out grinding is completed. This modification is applicable in the case that the judgment as to whether the retraction grinding has been completed or not is executed in dependence on whether or not the grinding resistance Ft has reached the set value Fϵ2, and also in the case that the judgment as to whether the retraction grinding has been completed or not is executed in dependence on whether or not the outer diameter Dt of the workpiece W has reached the set finish diameter Df1 as described in the first modified form of the foregoing fourth embodiment.

(Fifth Embodiment)

A grinding method in a fifth embodiment will be described with reference to FIGS. 1 and 17 through 19. The grinding method practiced on the grinding machine in the fifth embodiment is a method of performing a first advance grinding, then performing a retraction grinding and finally performing a spark-out grinding. In the first advance grinding, a position control is executed to make the feed rate of the wheel head 42 constant. It is designed that a grinding allowance Rϵ2 is to be left over the whole circumference of the workpiece W when the first advance grinding is completed. This allowance Rϵ2 is set to be thicker than the depth of an affected layer which is made in the first advance grinding. The depth of the affected layer is determined based on a measured value for which a measuring is carried out while the first advance grinding is performed, or is set based on the result of experimentations carried out in advance if such measuring is not performed.

Then, in the retraction grinding, a feedback control is performed to make the grinding resistance Ft follow or agree with a target grinding resistance Fe. The workpiece W is rotated a predetermined number of turns during the retraction grinding in this embodiment. The target grinding resistance Fe(θ) is set to gradually become smaller for each turn of the workpiece W in the retraction grinding. Further, like the third embodiment, this embodiment is designed so that the completion time of the retraction grinding is the time when the grinding resistance Ft reaches a resistance component (hereafter referred to as "dynamic pressure effect equivalent value") Fϵ1 which arises due to the influence of a dynamic pressure caused by coolant fluid. Further, the position at which the spark-out grinding is started is determined taking the dynamic pressure effect equivalent value Fϵ1 into consideration.

Figure 17:
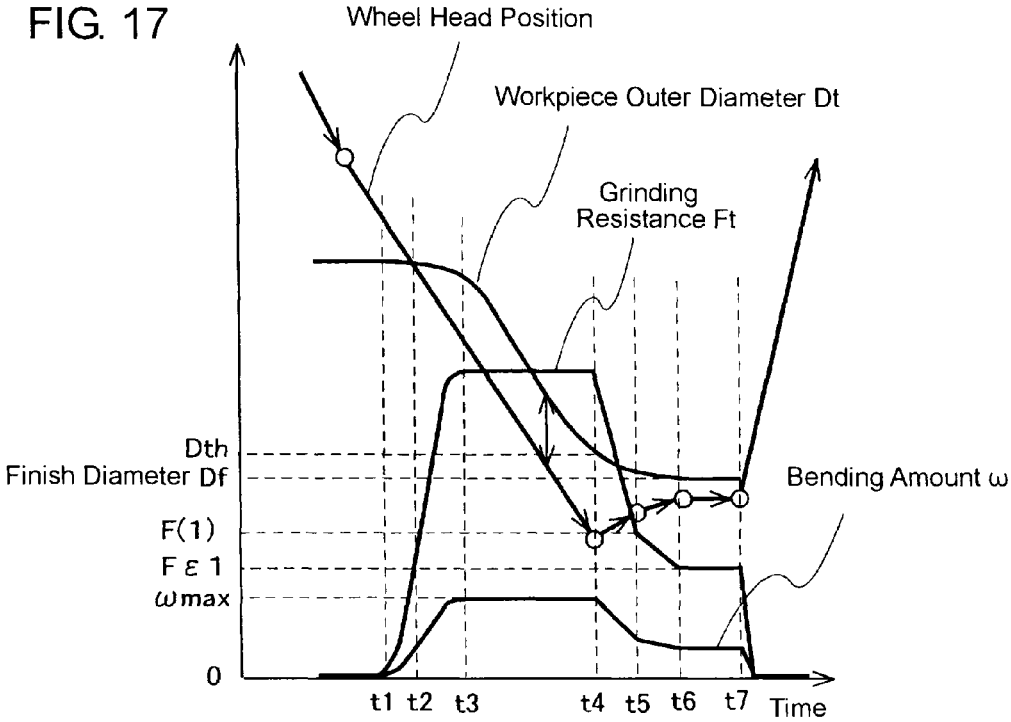
FIG. 17 is a graph showing wheel head position, workpiece outer diameter Dt, grinding resistance Ft and bending amount ω with the lapse of time in a fifth embodiment.

As shown in FIG. 17, the period from time t1 through time t4, that is, the first advance grinding is the same as that in the foregoing third embodiment. However, the outer diameter Dth set in the present embodiment is defined by expression Df−ωmax+Rϵ2. In order to determine the grinding allowance Rϵ2, a processing is executed to infer the depth of an affected layer which is made in the first advance grinding. This processing can be done by inferring the depth in advance from the condition for the first advance grinding or can be executed by measuring the affected layer as the first advance grinding is being performed. For measuring the affected layer, there can be used a known method using, e.g., an eddy current sensor or the like. Then, the grinding allowance Rϵ2 is set to a value equal to or greater than the inferred depth of the affected layer. Thus, when the first advance grinding is completed (time t4 in FIG. 17), the workpiece W results in having the grinding allowance Rϵ2 equal to or greater than the inferred affected layer, over the whole circumference thereof.

The retraction grinding is started following the first advance grinding. A first retraction grinding is performed for the period from time t4 to time t5 in FIG. 17. Then, a second retraction grinding is executed for the period from time t5 to time t6. Each retraction grinding is performed while the workpiece W is turned one complete rotation. It is designed and controlled that the grinding resistance Ft comes to agreement to the dynamic pressure effect equivalent value Fϵ1 upon completion of the second retraction grinding. That is, a residual grinding amount from the grinding allowance in the first advance grinding and the grinding allowance Rϵ2 are ground respectively in the first retraction grinding and the second retraction grinding. The spark-out grinding is performed upon completion of the second retraction grinding.

Figure 18:
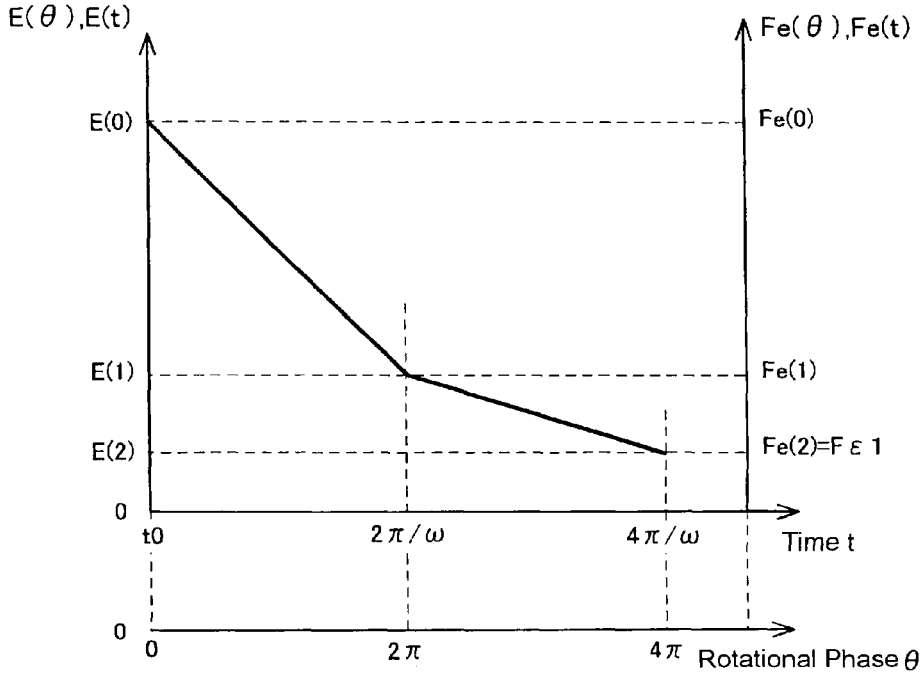
FIG. 18 is a graph showing the relations of residual grinding amount E(θ) and target grinding resistance Fe(θ) relative to the rotational phase θ of the workpiece in the fifth embodiment.

Now, the retraction grindings at the respective times in the present embodiment will be described in detail with reference to FIG. 18. As shown in FIG. 18, when the rotational phase θ of the workpiece W is 0 degree (corresponding to "present rotational phase θt" in the claimed invention), the residual grinding amount becomes E(0). The target grinding resistance at this time is set to Fe(0). The time at which the rotational phase θ of the workpiece W is 0 degree means when the first retraction grinding is started.

Then, when the rotational phase θ of the workpiece W is 2π degrees (corresponding to "target rotational phase θt" in the claimed invention), the target grinding resistance Fe(θe) is set to become Fe(1). The value Fe(1) is a value which is smaller than Fe(0), but greater than the dynamic pressure effect equivalent value Fϵ1. The value Fe(1) is set to a value which is closer to Fϵ1 than Fe(0). The residual grinding amount at this time becomes E(1). The time at which the rotational phase θ of the workpiece W is 2π degrees means not only when the first retraction grinding is competed but also when the second retraction grinding starts.

Then, when the rotational phase θ of the workpiece W is 4π degrees, the target grinding resistance Fe(θe) is set to become the dynamic pressure effect equivalent value Fϵ1. The residual grinding amount at this time becomes E(2). The time at which the rotational phase θ of the workpiece W is 4π degrees means when the second retraction grinding is completed.

Figure 19A:
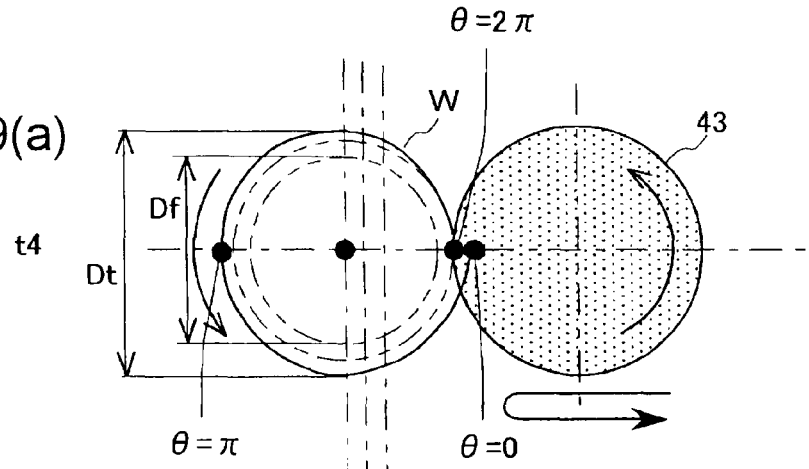
FIGS. 19(*a*)-19(*c*) are explanatory views for showing the positions of a workpiece and a grinding wheel at respective times t4-t6 in FIG. 17, wherein FIG. 19(*a*) shows the state at time t4 in FIG. 17, FIG. 19(*b*) shows the state at time t5 in FIG. 17 and FIG. 19(*c*) shows the state at time t6 in FIG. 17.
Figure 19B:
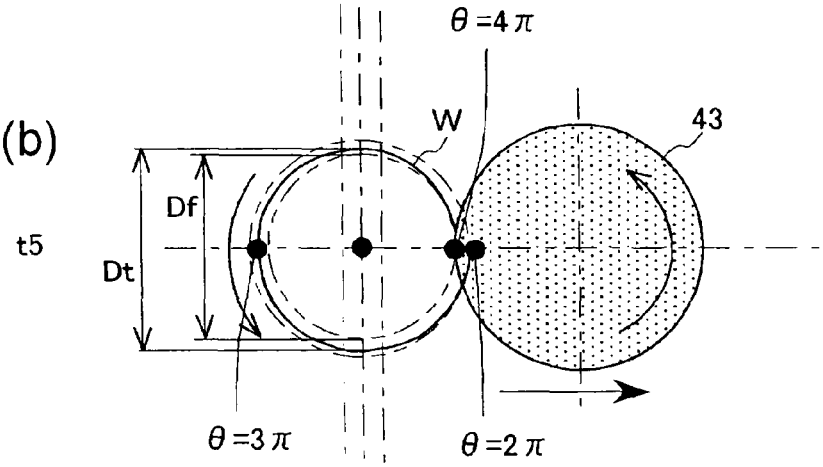
Figure 19C:
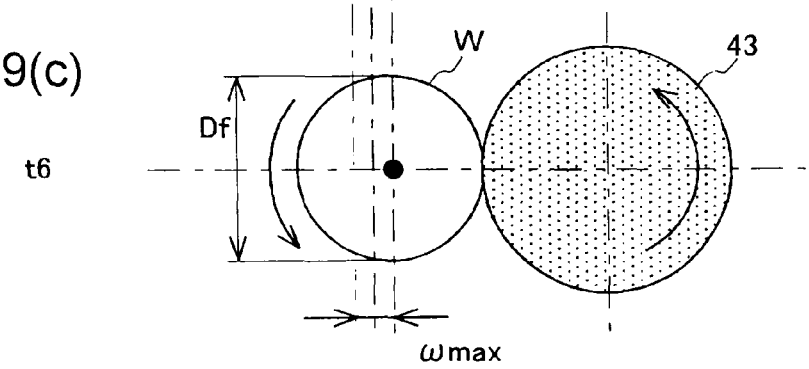

The retraction grinding will be described in more detail with reference to FIGS. 19(*a*)-19(*c*). At time t4 in FIG. 17, the workpiece W becomes the shape shown in FIG. 19(*a*). The rotational phase θ in FIG. 19 corresponds to that in FIG. 18. Then, at time t5 in FIG. 17, the workpiece W becomes the shape shown in FIG. 19(*b*). That is, as shown in FIGS. 19(*a*) and 19(*b*), the second retraction grinding is less in grinding amount than the first retraction grinding. Then, at time t6 in FIG. 17, the workpiece W becomes an approximately true circle shape shown in FIG. 19(*c*).

Although the retraction grinding is performed for two rotations of the workpiece W in the present embodiment, it may be performed for three or more rotations of the workpiece. In this case, it is preferable that the time-dependant change of the target grinding resistance Fe(θ) becomes smaller as the number of rotations of the workpiece increases.

According to the present embodiment, the retraction grinding is performed through plural number of workpiece rotations. That is, the retraction grinding with the workpiece rotation at a later time operates like a finish grinding. Thus, it is possible to perform in turn a retraction grinding equivalent to a rough grinding, a retraction grinding equivalent to a fine grinding, a retraction grinding equivalent to a minute grinding and so on while the retraction grinding is performed during the plural turns of the workpiece W. As a result, it is possible to perform a grinding operation which is very high in precision. Further, since the grinding allowance Rϵ2 is set to be equal to or greater than the depth of the affected layer made in the first advance grinding, it is possible to reliably remove the affected layer which is made in the first advance grinding, in the retraction grinding. Accordingly, the cylindrical workpiece on which the retraction grinding is completed does not have an affected layer. That is, it is possible to reliably enhance the quality of the workpiece.

(Sixth Embodiment)

A grinding method in a sixth embodiment will be described with reference to FIGS. 1 and 20(*a*) through 23. The grinding method practiced on the grinding machine in the sixth embodiment is a method of performing a first advance grinding, then performing a retraction grinding and finally performing a spark-out grinding. In the first advance grinding, a position control is executed to make the feed rate of the wheel head 42 constant. In the retraction grinding, a feedback control is executed to make the grinding resistance Ft follow or agree with a target grinding resistance Fe(θ). However, this method is applied in the case that in the first advance grinding, a stationary state does not arise completely or does not continue during one full turn or more of the workpiece W even if arising. That is, in the retraction grinding, the target grinding resistance Fe(θ) is set not to have a linear relation with the rotational phase θ but to have a nonlinear relation therewith.

Therefore, first of all, with reference to FIGS. 20(*a*) and 20(*b*), description will be made regarding the target grinding resistance Fe(θ) in the retraction grinding in the case that a stationary state arises in the first advance grinding and also regarding the target grinding resistance Fe(θ) in the retraction grinding in the case that no stationary state arises in the first advance grinding. First, in the case that a stationary state arises in the first advance grinding as shown in FIG. 20(*a*), the target grinding resistance Fe(θ) is set to have a linear relation with the lapse of time, as mentioned earlier in the foregoing embodiments.

Figure 20A:
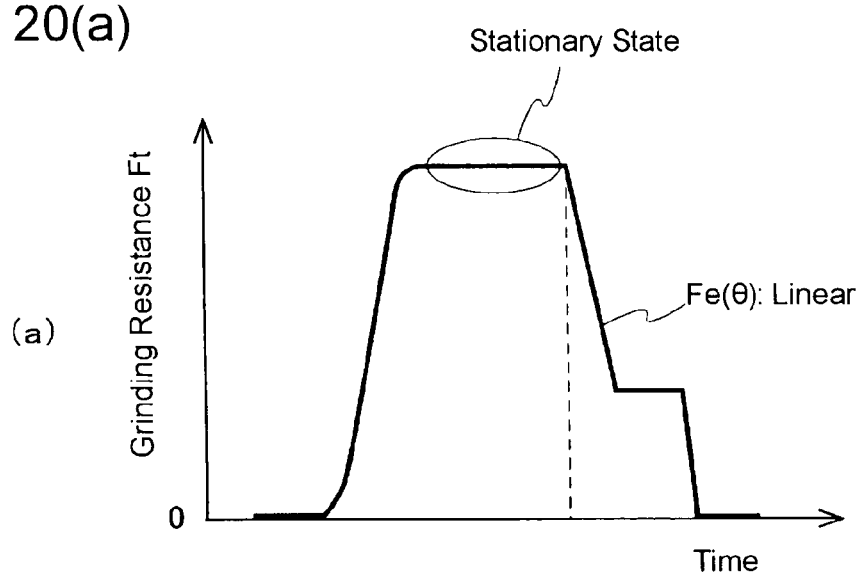
FIGS. 20(*a*) and 20(*b*) are graphs in a sixth embodiment, wherein FIG. 20(*a*) shows the time-dependant change of target grinding resistance Fe(θ) in a retraction grinding in the case of a stationary state being present in a preceding advance grinding, while FIG. 20(*b*) shows the time-dependant change of target grinding resistance Fe(θ) in a retraction grinding in the case of a stationary state being absent in a preceding advance grinding.
Figure 20B:
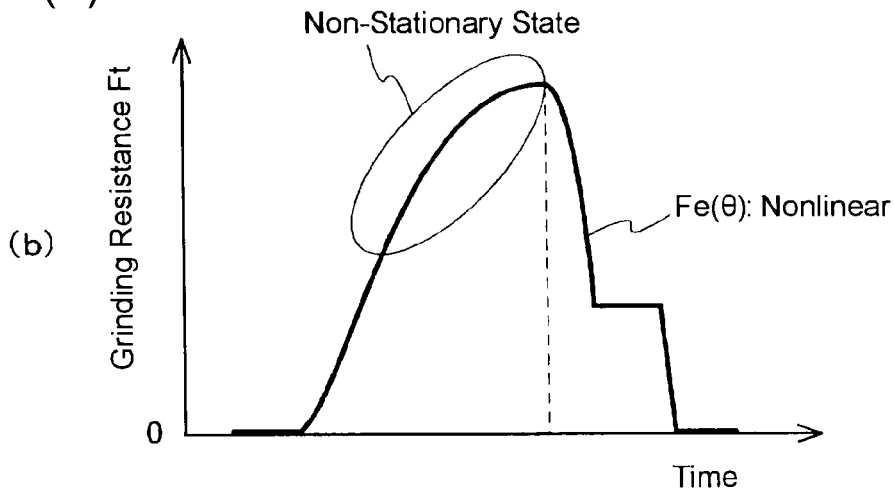

On the other hand, in the case that no stationary state arises in the first advance grinding as shown in FIG. 20(*b*), the residual grinding amount E(θ) does not have a linear relation with the rotational phase θ. Therefore, at the completion time of the first advance grinding, the residual grinding amounts and the respective rotational phases θ have a non-linear relation. Therefore, the target grinding resistances Fe(θ) in the retraction grinding are set so that grinding amounts in the respective rotational phases θ correspond respectively to the residual grinding amounts in the respective rotational phases θ in the first advance grinding. More specifically, the target grinding resistances Fe(θ) in the retraction grinding are set based on the grinding resistances Ft and the outer diameters Dt of the workpiece W in the respective rotational phases θ in the first advance grinding.

Further, in comparison with the case that a stationary state arises in the first advance grinding, it is not easy in the case that no stationary state arises, to determine the timing which makes the switching from the first advance grinding to the retraction grinding. In the present embodiment, the timing to make the switching from the first advance grinding to the retraction grinding is determined based on the grinding resistances Ft and the outer diameters Dt of the workpiece W in the course of the first advance grinding being performed.

Figure 21:
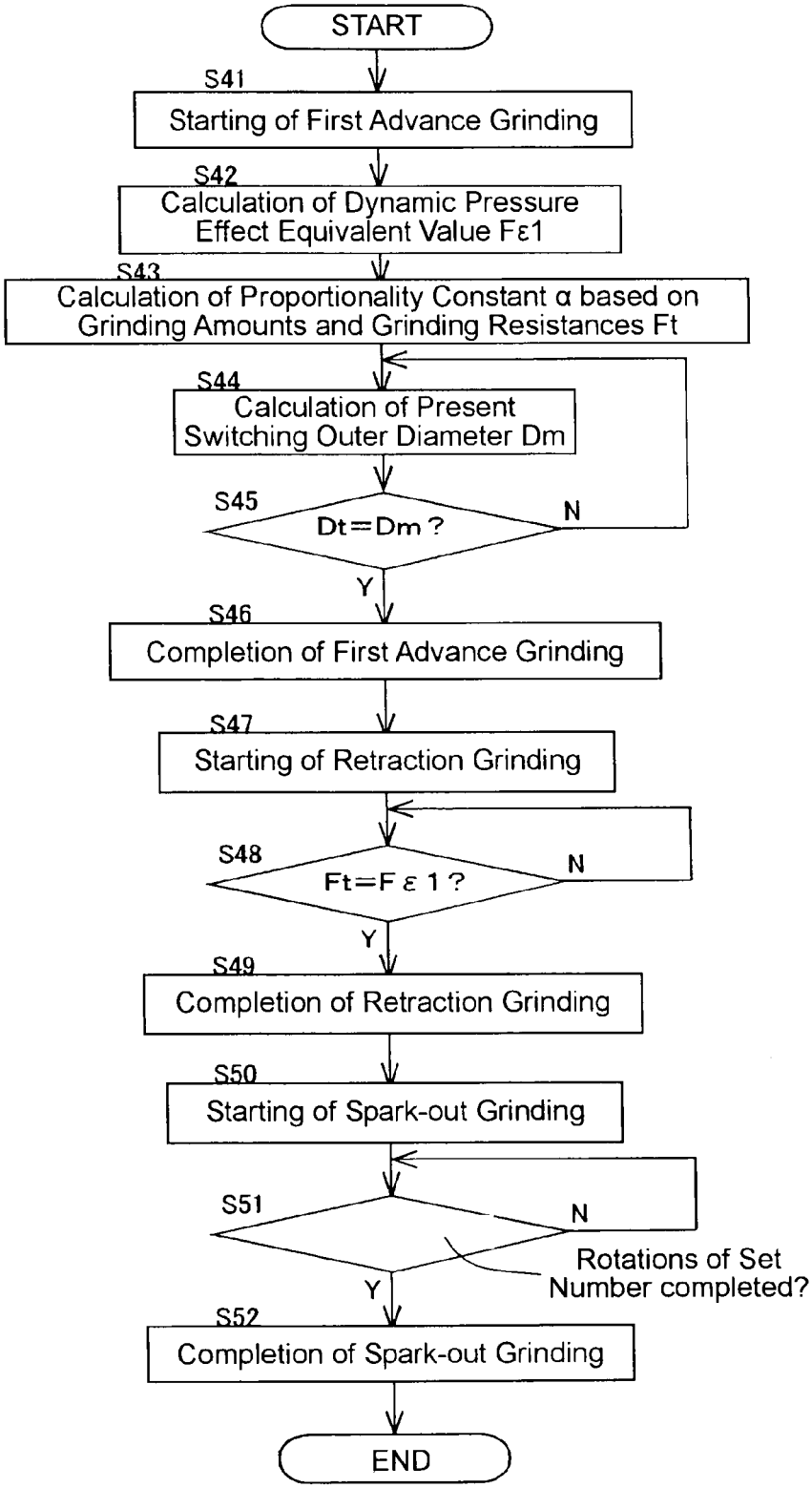
FIG. 21 is a flowchart showing a grinding method practiced on the grinding machine in the sixth embodiment.
Figure 22:
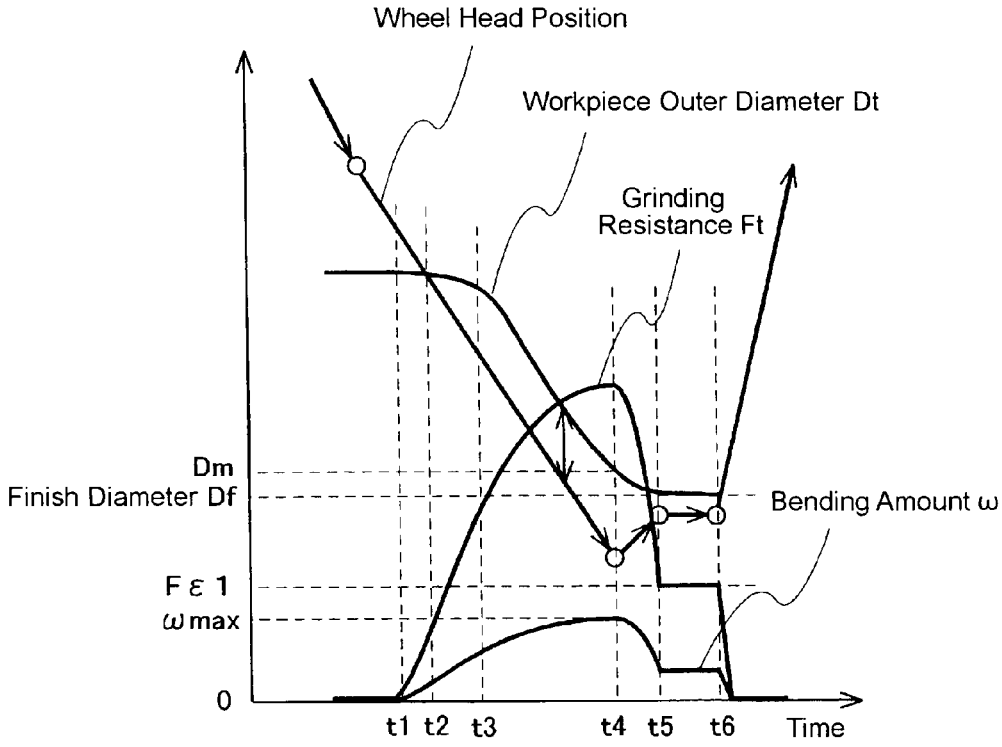
FIG. 22 is a graph showing wheel head position, workpiece outer diameter Dt, grinding resistance Ft and bending amount ω with the lapse of time in the sixth embodiment.

A grinding method in the present embodiment will be described with reference to FIGS. 21 and 22. As shown in FIG. 21 showing a grinding control program executed by the controller 70 in the sixth embodiment, the first advance grinding is started (S41). The first advance grinding corresponds to the period from time t1 through time t4 in FIG. 22. Description will be omitted regarding this period because of being the same as that in the foregoing third embodiment.

Then, the aforementioned dynamic pressure effect equivalent value Fε1 is calculated (S42). The calculation of the dynamic pressure effect equivalent value Fε1 is made based on the outer diameters Dt of the workpiece W and the grinding resistances Ft in the transition state (the period from time t2 to time t3). Then, a proportionality constant α is calculated based on the grinding amount per time of the workpiece W and the grinding resistances Ft (S43). The grinding amount per time of the workpiece W is calculated based on the outer diameters Dt of the workpiece W detected by the sizing device 60.

Then, an outer diameter Dm which the workpiece W has at the completion time of the present first advance grinding (hereafter referred to as "switching outer diameter") is calculated by the following expression (1) (S44). That is, the switching outer diameter Dm at present is calculated based not only the already calculated values α and Fε1 but also on a grinding resistance Ft(t) at present detected by the force sensor 50.

$$Dm = Df + \frac{Ft(t) - F\varepsilon 1}{\alpha} + \left[2Ft(t) - F\left(t - \frac{\pi}{2\omega}\right) - F\left(t - \frac{3\pi}{2\omega}\right)\right] \quad (1)$$

Here, Df denotes finish diameter, Ft(t) denotes grinding resistance Ft at the present time t, and ω denotes angular velocity of workpiece.

Subsequently, a judgment is made as to whether or not the outer diameter Dt of the workpiece W detected by the sizing device 60 has reached the calculated switching outer diameter Dm (S45). Unless the outer diameter Dt of the workpiece W has reached the calculated switching outer diameter Dm yet (S45: N), the first advance grinding is continued, and a return is then made to step S44 to calculate the switching outer diameter Dm at present again (to renew the same). If the outer diameter Dt of the workpiece W has reached the calculated switching outer diameter Dm (S45: Y), the first advance grinding is completed (S46).

Thereafter, the retraction grinding is started (S47). That is, when the outer diameter Dt of the workpiece W reaches the switching outer diameter Dm, a switching is made from the first advance grinding to the retraction grinding. In this retraction grinding, target grinding resistances Fe are set to make it possible to grind the residual grinding amounts E. The residual grinding amounts E can be expressed by the following expression (2). Further, the target grinding resistances Fe can be expressed by the following expression (3).

$$E(t) = E(t0) \cdot \left\{1 - \frac{\omega}{2\pi}(t - t0)\right\} + \frac{F\left(t - \frac{2\pi}{\omega}\right)}{\alpha} \quad (2)$$

$$Fe(t) = 2 \cdot Ft(t0) - Ft\left(t - \frac{2\pi}{\omega}\right) - \frac{\omega}{2\pi} \cdot \{Ft(t0) - F\varepsilon 1\} \cdot (t - t0) \quad (3)$$

Here, E(t) denotes residual grinding amount at time t, t denotes the present time, t0 denotes the time when the retraction grinding is started, and Fe(t) denotes target grinding resistance at time t. Because the time t agrees to the rotational phase θ, E(t) is substantially equivalent to E(θ), and thus, Fe(t) is substantially equivalent to Fe(θ).

Then, a judgment is made as to whether or not the grinding resistance Ft has reached the dynamic pressure effect equivalent value Fε1 (S48). If the grinding resistance Ft has not reached the dynamic pressure effect equivalent value Fε1 (S48: N), the retraction grinding is continued. If the grinding resistance Ft has reached the dynamic pressure effect equivalent value Fε1 (S48: Y), on the contrary, the retraction grinding is completed (S49). The target grinding resistances Fe(θ) calculated by the aforementioned expression (3) are set so that the grinding resistant Ft becomes the dynamic pressure effect equivalent value Fε1 at the completion time of the retraction grinding (i.e., when the target rotational phase θe is reached).

Upon completion of the retraction grinding, the spark-out grinding is performed (S50). The spark-out grinding is performed with the infeed amount of the grinding wheel 43 against the workpiece W held zero. That is, in the spark-out grinding, the position of the wheel head 42 is a position which deviates by a dimension corresponding to the dynamic pressure effect equivalent value Fε1, from the position where it should be to grind the workpiece W to the finish diameter Df. The spark-out grinding is carried out only during the period for the workpiece W to turn a predetermined number of times. Therefore, it is judged whether or not the workpiece W has been rotated the predetermined number of turns (S51), and the spark-out grinding is completed when the predetermined number of turns are completed (S52).

Figure 23:
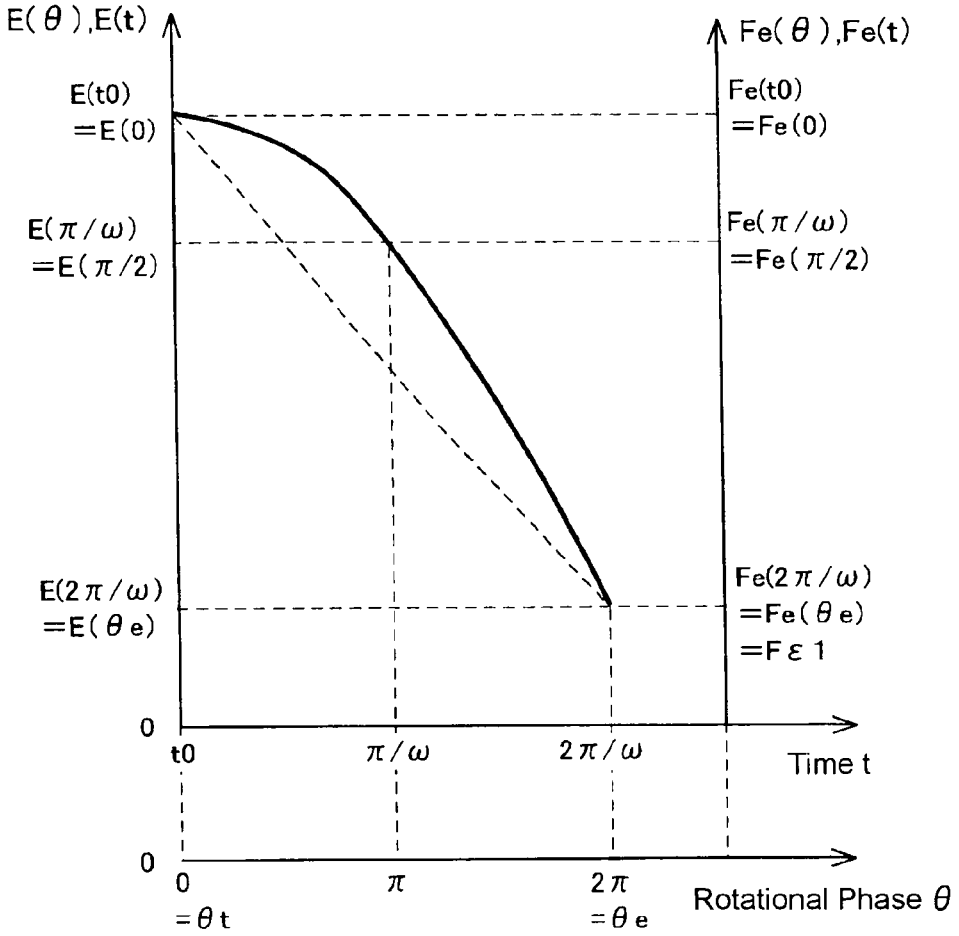
FIG. 23 is a graph showing the relations of residual grinding amount E(θ) and target grinding resistance Fe(θ) relative to the rotational phase θ of the workpiece in the sixth embodiment.

Now, the retraction grinding in the present embodiment will be described with reference to FIG. 23. As shown in FIG. 23, when the rotational phase θ of the workpiece W is 0 degree (corresponding to "present rotational phase θt" in the claimed invention), the residual grinding amount becomes E(0). The target grinding resistance at this time is set to Fe(0). Then, when the rotational phase θ of the workpiece W is 2π degrees (corresponding to "target rotational phase θe" in the claimed invention), the target grinding resistance Fe(θe) is set to become the dynamic pressure effect equivalent value Fε1. The residual grinding amount at this time is E(θe).

According to the present embodiment, even where the residual grinding amounts E(θ) in the respective rotational phases θ change nonlinearly while the workpiece W turns from the present rotational phase θt to reach the target rotational phase θe, it is possible to set the target grinding resistances Fe(θ) (or Fe(t)) in the retraction grinding in dependence on the residual grinding amounts E(θ) (or E(t)). That is, the grinding remainder left after the first advance grinding can reliably be ground in the retraction grinding, and hence, it is possible to enhance the grinding accuracy.

(First Modified Form of Sixth Embodiment)

In the foregoing sixth embodiment, as shown at step S48 in FIG. 21, the judgment as to the completion of the retraction grinding is made in dependence on whether or not the grinding resistance Ft has reached the dynamic pressure effect equivalent value Fε1. Instead, the retraction grinding may be completed when the outer diameter Dt of the workpiece W detected by the sizing device 60 has reached the predetermined finish diameter Df. That is, the step S48 in FIG. 21 may be modified so that a judgment is made as to whether or not the outer diameter Dt of the workpiece W detected by the sizing device 60 has reached the finish diameter Df and that if the outer diameter Dt of the workpiece W has reached the finish diameter Df (S48: Y), the retraction grinding is completed.

(Second Modified Form of Sixth Embodiment)

Further, in the foregoing sixth embodiment, as shown at step S51 in FIG. 21, the judgment as to the completion of the spark-out grinding is made in dependence on whether or not the workpiece has rotated through the predetermined number of turns. Instead, the spark-out grinding may be completed when the outer diameter Dt of the workpiece W detected by the sizing device 60 reaches the predetermined finish diameter Df. That is, the step S51 in FIG. 21 may be modified so that a judgment is made as to whether or not the outer diameter Dt of the workpiece W detected by the sizing device 60 has reached the finish diameter Df and that if the outer diameter Dt of the workpiece W has reached the finish diameter Df (S51: Y), the spark-out grinding is completed. This modification is applicable in the case that the completion of the retraction grinding is judged in dependence on whether or not the grinding resistance Ft has reached the dynamic pressure effect equivalent value Fε1.

(Seventh Embodiment)

A grinding method in a seventh embodiment will be described with reference to FIGS. 1, 24 and 25. The grinding method practiced on the grinding machine in the seventh embodiment is a method of performing a first advance grinding, then performing a retraction grinding, then performing a second advance grinding, and finally performing a spark-out grinding. In the first advance grinding, a position control is executed to make the feed rate of the wheel head 42 constant. In the retraction grinding, a feedback control is executed to make the grinding resistance Ft follow or agree with a target grinding resistance Fe. In the second advance grinding, a constant grinding force control is performed to maintain the grinding resistance constant. That is, the second advance grinding is controlled to make the grinding amount per time become constant. Further, it is designed that at the completion time of each of the first advance grinding and the retraction grinding, a grinding allowance Rε3 is left over the whole circumference of the workpiece W. That is, the allowance Rε3 is to be ground in the second advance grinding.

Figure 24:
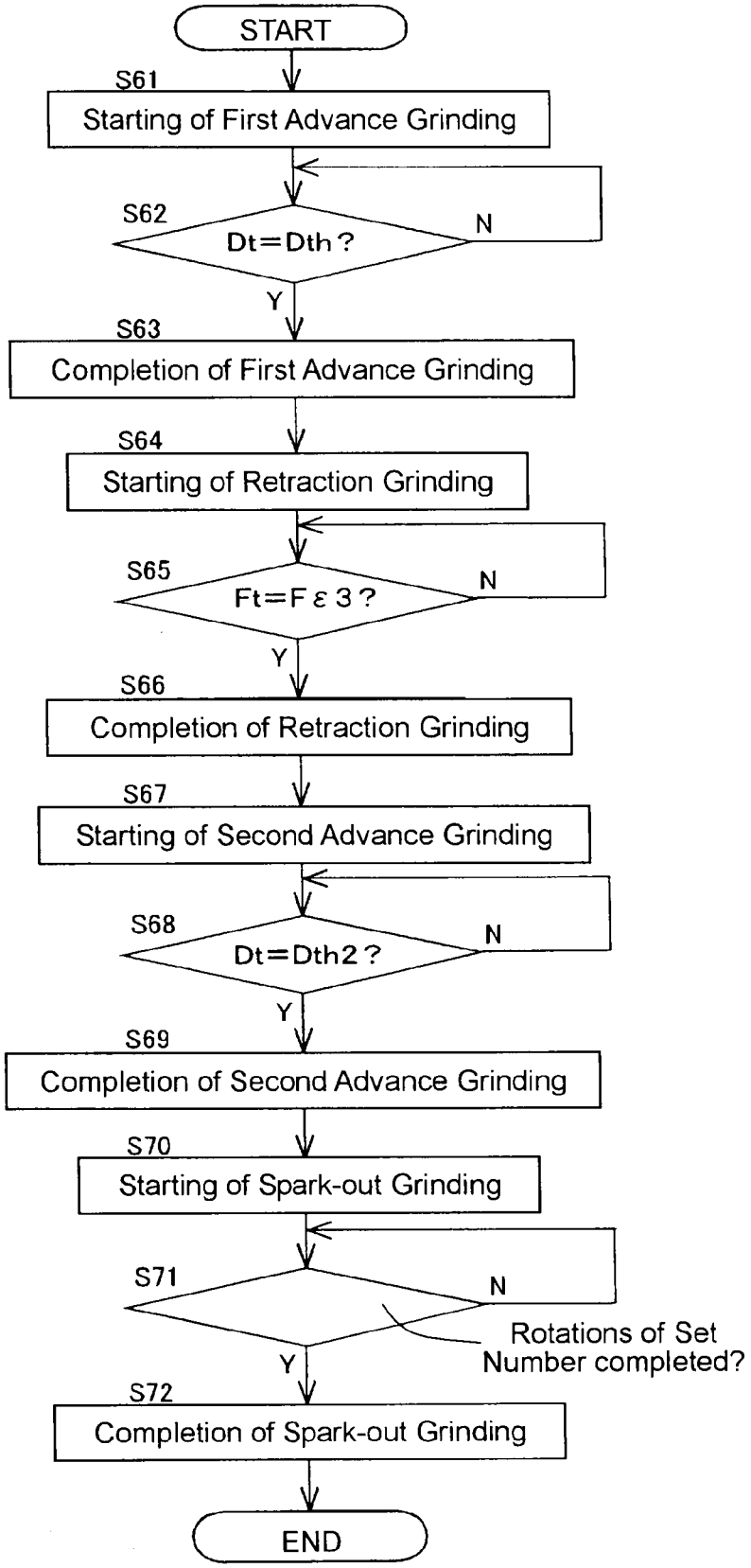
FIG. 24 is a flowchart showing a grinding method practiced on the grinding machine in a seventh embodiment.

As shown in FIG. 24 showing a grinding control program executed by the controller 70 in the seventh embodiment, the first advance grinding is started (S61). The first advance grinding corresponds to the period from time t1 through time t4 in FIG. 25. Description will be omitted regarding this period because of being the same as that in the foregoing first embodiment. Thereafter, a judgment is made as to whether or not the outer diameter Dt of the workpiece W has reached the predetermined outer diameter Dth (S62). The set outer diameter Dth is expressed by expression Df−ωmax+Rε3. That is, the grinding allowance Rε3 is left over the whole circumference of the workpiece W at the completion time of the first advance grinding (i.e., at time t4 in FIG. 25).

Further, if the outer diameter Dt of the workpiece W has not yet reached the set value Dth (S62: N), the first advance grinding is continued. When the outer diameter Dt of the workpiece W has reached the set value Dth (S62: Y), on the contrary, the first advance grinding is completed (S63).

Then, the retraction grinding is started (S64). That is, the switching from the first advance grinding to the retraction grinding is made when the outer diameter Dt of the workpiece W reaches the set value Dth. Then, it is judged whether or not the grinding resistance Ft has reached the set value Fε3 (S65). The set value Fε3 is the grinding resistance Ft in the state that the outer diameter Dt of the workpiece W reaches the set value Dth. That is, the target grinding resistance Fe(θ) is set so that the grinding resistance Ft comes to agreement with the set value Fε3 at the completion time of the retraction grinding (i.e., when the target rotational phase θe is reached).

Further, if the grinding resistance Ft has not reached the set value Fε3 (S65: N), the retraction grinding is continued. If the grinding resistance Ft has reached the set value Fε3 (S65: Y), on the contrary, the retraction grinding is completed (S66).

Upon completion of the retraction grinding, the second advance grinding is started (S67). In the second advance grinding, the position control of the wheel head 42 is executed to keep the grinding resistance Ft constant. Instead of the position control, a feedback control on the basis of the grinding resistance Ft may be performed in the second advance grinding. The grinding resistance Ft controlled to be constant in the second advance grinding is set to a value which is very small in comparison with the maximum grinding resistance Ft in the first advance grinding. That is, the first advance grinding is regarded as rough machining, whereas the second advance grinding is regarded as finish machining.

Then, a judgment is made as to whether or not the outer diameter Dt of the workpiece W has reached a predetermined outer diameter Dth2 (S68). The set outer diameter Dth2 corresponds to a finish diameter. However, because the detected outer diameter Dt of the workpiece W slightly differs in dependence on the phase position detected by the sizing device 60, the outer diameter Dth2 is set taking such difference into consideration. Then, if the outer diameter Dt of the workpiece W has not yet reached the set value Dth2 (S68: N), the second advance grinding is continued. If the outer diameter Dt of the workpiece W has reached the set value Dth2 (S68: Y), the second advance grinding is completed (S69).

Subsequently, the spark-out grinding is performed (S70). The spark-out grinding is performed with the infeed amount of the grinding wheel 43 against the workpiece W held zero. That is, the spark-out grinding results in grinding the grinding remainder which was left in the second advance grinding. The spark-out grinding is carried out only during the period for the workpiece W to turn a predetermined number of times. Therefore, it is judged whether or not the workpiece W has been rotated the predetermined number of turns (S71), and the spark-out grinding is completed when the turns of the predetermined number are completed (S72).

According to the present embodiment, the second advance grinding which is controlled to keep the grinding resistance Ft constant is performed following the retraction grinding. Thus, even if a non-uniformity (variation) in dimensions at respective phases arise in the retraction grinding, such a non-uniformity can reliably be removed in the second advance grinding. Accordingly, a precise grinding can be realized.

Further, the spark-out grinding is performed following the second advance grinding. The second advance grinding is an advance grinding which is controlled to keep the grinding resistance constant. Therefore, theoretically, it is considered that a step is produced between a part of the workpiece W at which part the second advance grinding has been completed, and another part of the workpiece W in a rotational phase θ being ahead a little. The step can be removed by performing the spark-out grinding. That is, even if such a step is produced in the second advance grinding, it is possible to make the finally ground finish surface precise by the spark-out grinding.

(First Modified Form of Seventh Embodiment)

In the foregoing seventh embodiment, as shown at step S65 in FIG. 24, the judgment as to the completion of the retraction grinding is made in dependence on whether or not the grinding resistance Ft has reached the set value F$\epsilon$3. Instead, the retraction grinding may be completed if the outer diameter Dt of the workpiece W detected by the sizing device 60 has reached the set diameter Df3 (indicated in FIG. 25). That is, the step S65 in FIG. 24 may be modified so that a judgment is made as to whether or not the outer diameter Dt of the workpiece W detected by the sizing device 60 has reached the set diameter Df3 and that if the outer diameter Dt of the workpiece W has reached the set diameter Df3 (S65: Y), the retraction grinding is completed. The set diameter Df3 is the outer diameter Df of the workpiece W when the grinding resistance Ft agrees with (i.e., decreases to) the set value F$\epsilon$3.

(Second Modified Form of Seventh Embodiment)

Further, in the foregoing seventh embodiment, as shown at step S71 in FIG. 24, the judgment as to the completion of the spark-out grinding is made in dependence on whether or not the workpiece has rotated through the predetermined number of turns. Instead, the spark-out grinding may be completed when the outer diameter Dt of the workpiece W detected by the sizing device 60 has reached the set finish diameter Df. That is, the step S71 in FIG. 24 may be modified so that a judgment is made as to whether or not the outer diameter Dt of the workpiece W detected by the sizing device 60 has reached the finish diameter Df and that if the outer diameter Dt of the workpiece W has reached the finish diameter Df (S71: Y), the spark-out grinding is completed.

(Modified Forms Common to First to Seventh Embodiments)

In each of the foregoing embodiments, the force sensor 50 is used for detecting the grinding resistance Ft. Instead, in order to detect the grinding resistance Ft, there is utilized a drive torque which the work spindle motor 23 generates to rotationally drive the workpiece W. To this end, a torque sensor 50*a* which is interposed between the work spindle drive motor 23 and the work spindle 22 as shown in FIG. 1 can be used as the grinding resistance detection section 202. Further alternatively, an ammeter may be provided to detect such a drive torque. The same effects as those in the foregoing embodiments can be achieved also in each of these modified forms.

Further, in each of the foregoing embodiments, description has been made taking as an example the case that the external surface of a cylindrical workpiece W is ground. Besides, the present invention may likewise applicable in the case that an internal surface of a cylindrical workpiece W is ground.

(Eighth Embodiment)

(Description Regarding the Fundamentals of the Grinding Method)

Next, the fundamentals of a grinding method in the eighth embodiment will be described with reference to FIG. 26. First of all, an advance grinding is started. The advance grinding corresponds to the period from time t0 to time t4 in FIG. 26. That is, the advance grinding is a grinding which is performed by relatively moving the grinding wheel 43 in the first direction to be pressed on the workpiece W as a total bending amount value δ(t) of the workpiece W and the grinding wheel 43 is increased. More specifically, as indicated by the wheel head position in FIG. 26, the wheel head 42 is fed at a constant feed rate in the X-axis direction and in the first direction to be pressed against the workpiece W. The total bending amount value δ(t) will be described in detail.

Figure 26:
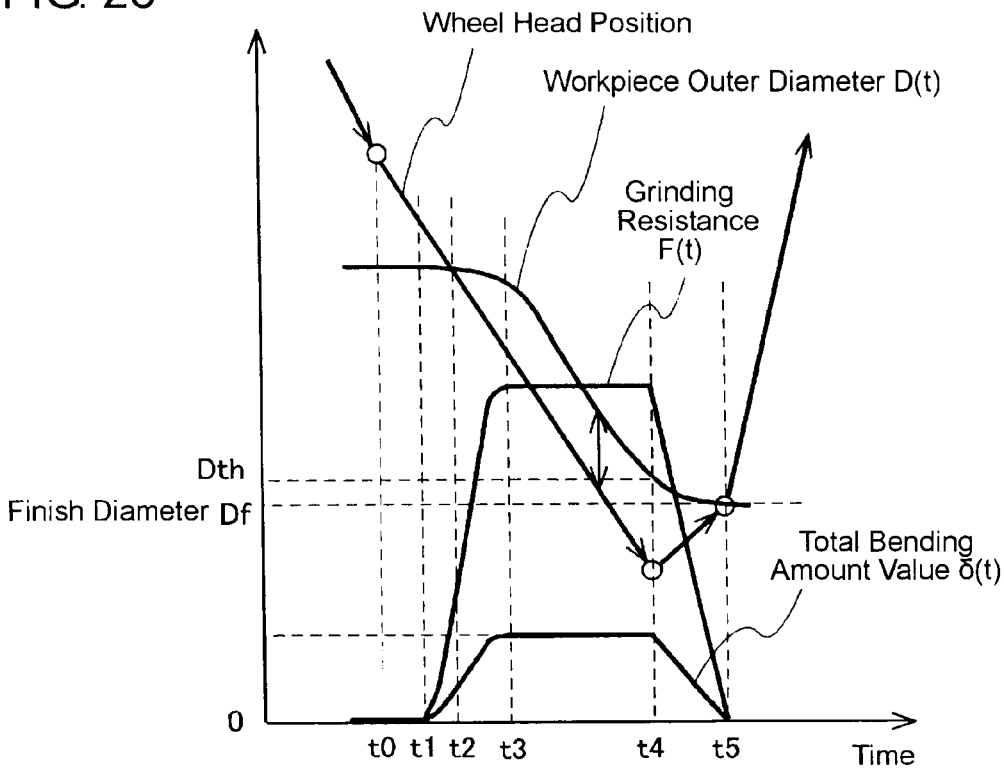
FIG. 26 is a graph showing wheel head position, workpiece outer diameter D(t), grinding resistance F(t) and total bending amount value δ(t) with the lapse of time t in an eighth embodiment.

For the period from time t0 to time t1 in FIG. 26, the grinding wheel 43 is still out of contact with the workpiece W. When the wheel head 42 is moved in the direction heading for the workpiece W, the grinding wheel 43 comes to contact with the workpiece W, as the curve indicating the wheel head position and the curve indicating the workpiece outer diameter D(t) crosses each other at time t2 in FIG. 26. At this time, the rotational center of the workpiece W is in agreement with the work spindle center.

Then, for the period from time t2 to time t3, the grinding resistance F(t) increases abruptly. At the same time, the total bending amount value δ(t) of the workpiece W and the grinding wheel 43 also increases. The state that the grinding resistance F(t) is changing, that is, the period from time t2 to time t3 in FIG. 26 is called "transition state".

Then, for the period from time t3 to t4 in FIG. 26, the grinding resistance F(t) is kept constant. At the same time, the total bending amount value δ(t) of the workpiece W and the grinding wheel 43 is also kept constant. The state that the grinding resistance F(t) is kept constant, that is, the period from time t3 to time t4 in FIG. 26 is called "stationary state".

Then, the advance grinding is completed when the outer diameter D(t) of the workpiece W reaches the set value Dth, and a retraction grinding is started. The retraction grinding is a grinding in which the grinding wheel 43 is relatively moved in the second direction to go away from the workpiece W as the total bending amount value δ(t) of the workpiece W and the grinding wheel 43 is decreased.

The retraction grinding is carried out for the period from time t4 to time t5 in FIG. 26. The workpiece W is rotated one complete turn during the period from time t4 to time t5, and the retraction grinding is completed when the workpiece W completes one complete turn. That is, one rotation of the workpiece W covers a rotational range that begins in the rotational phase θt of the workpiece W at the completion time t4 of the advance grinding and ends in the rotational phase θe of the workpiece W at the completion time t5 of the retraction grinding. The total bending amount value δ(t) of the workpiece W and the grinding wheel 43 is controlled to be decreased to zero at time t5 when the retraction grinding is completed.

(Explanation of the Total Bending Amount Value δ(t))

Figure 27:
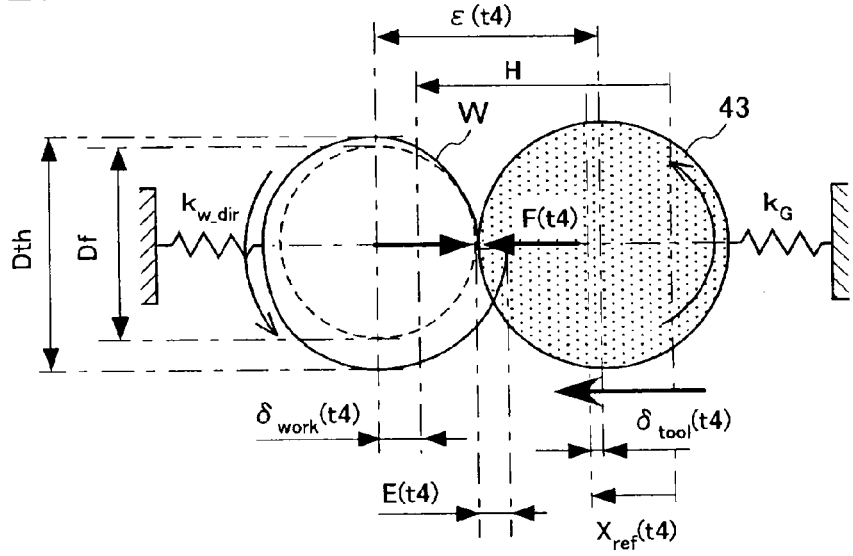
FIG. 27 is an explanatory view for showing the relation between a workpiece and a grinding wheel at a completion time t4 of an advance grinding in the eighth embodiment.

The total bending amount value δ(t) of the workpiece W and the grinding wheel 43 will be described with reference to FIG. 27. The grinding on the outer circumference of the workpiece W with the grinding wheel 43 is turned into a model expressed as shown in FIG. 27. The following description will be made regarding the completion time t4 of the advance grinding because the stationary state is easy to understand.

The total bending amount value δ(t) of the workpiece W and the grinding wheel 43 is the sum of a bending amount $S_{work}(t)$ of the workpiece W and a bending amount $\delta_{tool}(t)$, as expressed by the following expression (4). At the completion time t4 of the advance grinding, the expression (4) is expressed as the following expression (5) based on the Hooke's law. A composite spring constant $k_m$ in the expression (5) is made by compositing a spring constant $k_w$ in the support system for the workpiece W and a spring constant $k_G$ in the support system for the grinding wheel 43. That is, the reciprocal of the composite spring constant $k_m$ is a value which adds the reciprocal of the spring constant $k_w$ in the support system for the workpiece W and the reciprocal of the spring constant $k_G$ in the support system for the grinding wheel 43.

$$\delta_{total}(t) = \delta_{work}(t) + \delta_{tool}(t) \tag{4}$$

$$\begin{aligned}\delta_{total}(t) &= \frac{F(t4)}{k_w} + \frac{F(t4)}{k_G} \\ &= \left(\frac{1}{k_W} + \frac{1}{k_G}\right) \cdot F(t4) \\ &= \frac{1}{k_m} \cdot F(t4)\end{aligned} \tag{5}$$

Further, coolant fluid is used in performing the grinding operation. Thus, an actual total bending amount value $\delta_{total}(t)$ has to include a total bending amount value $\delta_c$ which is equivalent to a dynamic pressure effect caused by coolant fluid, in addition to a total bending amount value $\delta(t)$ built by the grinding resistant F(t). That is, these relations are expressed by the following expression (6). Thus, the following expression (7) can be derived from the expressions (5) and (6) and can be expressed as the following expression (8).

$$\delta_{total}(t) = \delta(t) + \delta_c \tag{6}$$

$$\begin{aligned}F(t4) &= k_m \cdot \delta_{total}(t) \\ &= k_m \cdot (\delta(t) + \delta_c)\end{aligned} \tag{7}$$

$$F(t4) - F_d = k_m \cdot \delta(t) \tag{8}$$

here:

$$F_d = k_m \cdot \delta_c$$

(Detailed Description of the Grinding Method)

Next, the details of the grinding method in the present embodiment will be described with reference to FIGS. 28 through 31. First, a control block diagram for the controller 70 and associated devices will be described with reference to FIG. 28. The control block diagram for the controller 70 shown in FIG. 28 includes a system for use in the advance grinding and another system for use in the retraction grinding. Those components encircled by the two-dot-chain line in FIG. 28 are configured as software or hardware function means incorporated in the controller 70.

Figure 28:
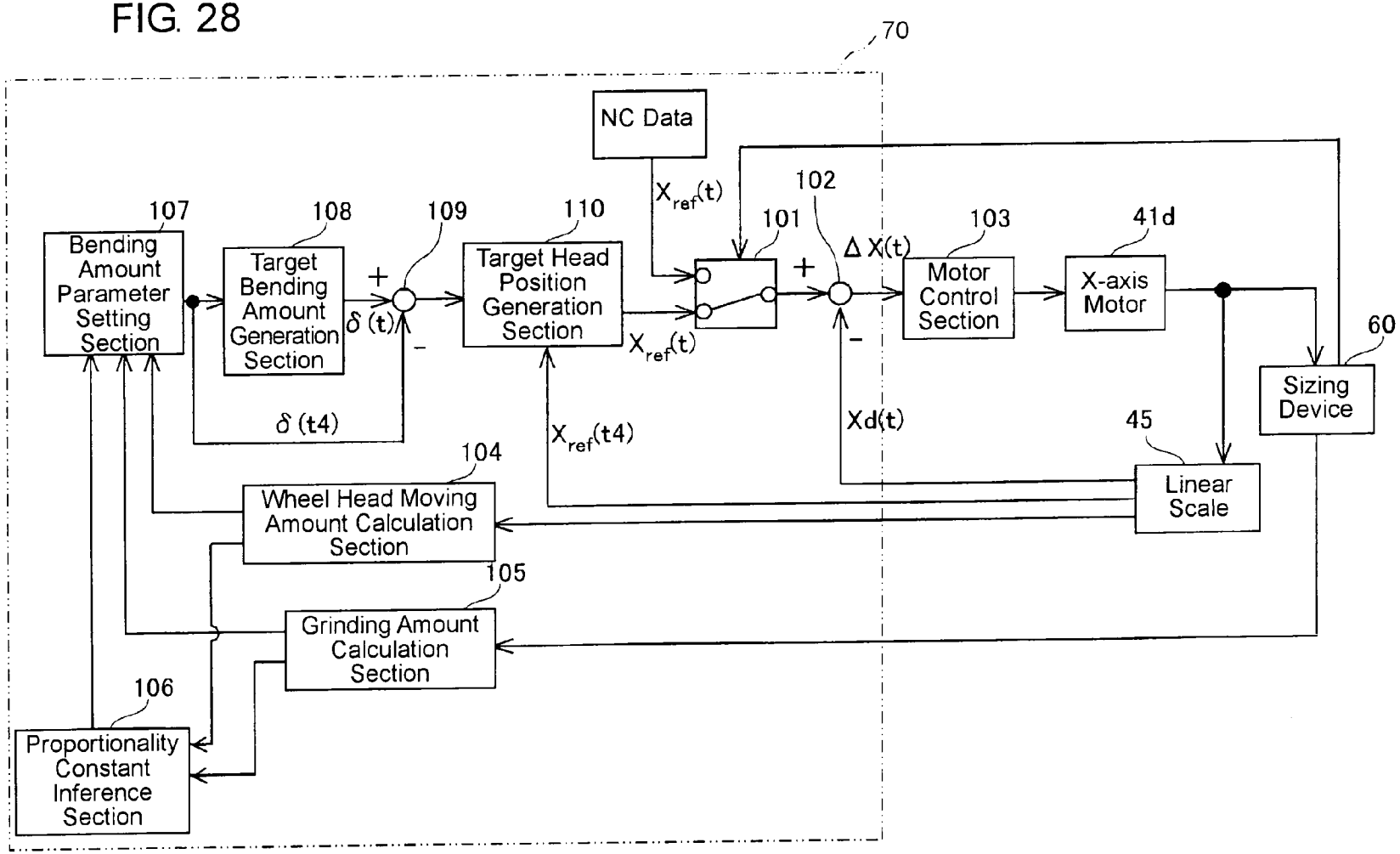
FIG. 28 is a block diagram of a controller 70 used in the eighth embodiment.

The advance grinding is controlled using a switching device 101, a subtracter 102, a motor control section 103, a linear scale 45, the sizing device 60, a wheel head moving amount calculation section 104, a grinding amount calculation section 105, a proportionality constant inference section 106, and a bending amount parameter setting section 107 in the control block diagram shown in FIG. 28.

The switching device 101 is responsive to a sizing signal outputted from the sizing device 60 to make the switching between the advance grinding and the retraction grinding. More specifically, until the outer diameter Dt of the workpiece W detected by the sizing device 60 reaches the set value Dth, the switching device 101 is switched for the advance grinding to input X-axis position command values $X_{ref}(t)$ of the wheel head 42 in the NC data stored in the controller 70. On the contrary, when the outer diameter Df of the workpiece W reaches the set value Dth, the switching device 101 is switched for the retraction grinding to input X-axis position command values $X_{ref}(t)$ of the wheel head 42 generated by a target head position generation section 110 referred to later.

The subtracter 102 calculates the difference $\Delta x(t)$ between the X-axis position command value $X_{ref}(t)$ of the wheel head 42 in the NC data outputted from the switching device 101 and an X-axis potion Xd(t) of the wheel head 42 detected by the linear scale 45. The motor control section 103 drives the X-axis motor 41*d* based on the difference $\Delta x(t)$ calculated by the subtracter 102 by executing, e.g., a proportional-plus-integral control. That is, the present X-axis position Xd(t) of the wheel head 42 detected by the linear scale 45 is controlled to follow the X-axis position command value $X_{ref}(t)$. Where the switching device 101 is connected with the NC data side, the subtracter 102 and the motor control section 103 correspond to "advance grinding control means" in the claimed invention.

The wheel head moving amount calculation section 104 (corresponding to "moving amount detection means" in the claimed invention) calculates a moving amount $\Delta Xd(ti)$ in the X-axis direction of the wheel head 42 for a certain period of time based on the X-axis position Xd(ti) of the wheel head 42 detected by the linear scale 45. That is, the moving amount $\Delta Xd(ti)$ is an amount which the wheel head 42 moves in the X-axis direction for a certain period of time in accordance with the NC data. More specifically, the wheel head moving amount calculation section 104 continues to calculate the moving amount $\Delta Xd(ti)$ in the X-axis direction of the wheel head 42 which is moved in accordance with the NC data, for the period from time $t_{i-1}$ to time $t_i$ (provided i is 1 through N) while the total bending amount value $\delta(t)$ in the transition state (time t2 to time t3 in FIG. 26) is increasing. That is, the moving amount $\Delta Xd(ti)$ is expressed by the following expression (9).

$$\Delta Xd(t_i) = Xd(t_i) - Xd(t_{i-1}) \tag{9}$$

The grinding amount calculation section 105 (corresponding to the "grinding amount detection means" in the claimed invention) calculates a radius decrease amount $E(t_i)$, E(t4) of the workpiece W brought about by the grinding for a certain period of time, based on the outer diameter Dt of the workpiece W detected by the sizing device 60. A first grinding amount $E(t_i)$ is a radius decrease amount of the workpiece W for the period from time $t_{i-1}$ to time $t_i$ (provided i is 1 through N) while the total bending amount value $\delta(t)$ in the transition state (time t2 to time t3 in FIG. 26) is increasing. The first grinding amount $E(t_i)$ is expressed by the following expression (10). A second grinding amount E(t4) is a radius decrease amount of the workpiece W from an outer diameter D(t0) in the state (t0) that the advance grinding is started, to an outer diameter D(t4) at the completion time (t4) of the advance grinding. The second grinding amount E(t4) is expressed by the following expression (11). Each of the first grinding amount $E(t_i)$ and the second grinding amount E(t4) corresponds to an infeed amount in the radial direction of the grinding wheel 43 against the workpiece W in a predetermined period of time.

$$E(t_i) = \frac{1}{2}\{D(t_i) - D(t_{i-1})\} \tag{10}$$

i: 1-N in Transition State (t2-T3)

$$E(t4) = \frac{1}{2}\{D(t4) - D(t0)\} \tag{11}$$

Figure 29A:
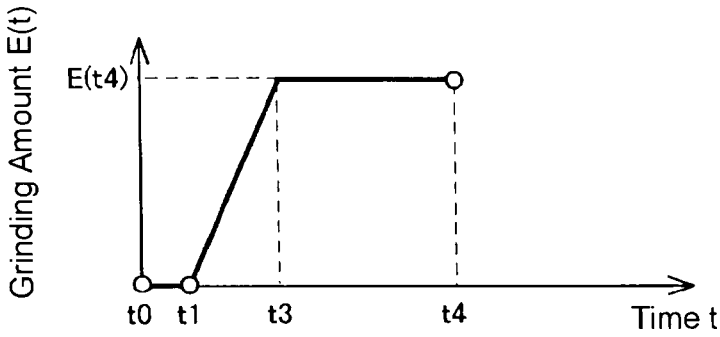
FIGS. 29(*a*)-29(*c*) are graphs in the eighth embodiment, wherein FIG. 29(*a*) shows a typical behavior of radius decrease amount (grinding amount) E(t) in grinding a workpiece for the period from starting time t1 to completion time t4 in an advance grinding.
Figure 29B:
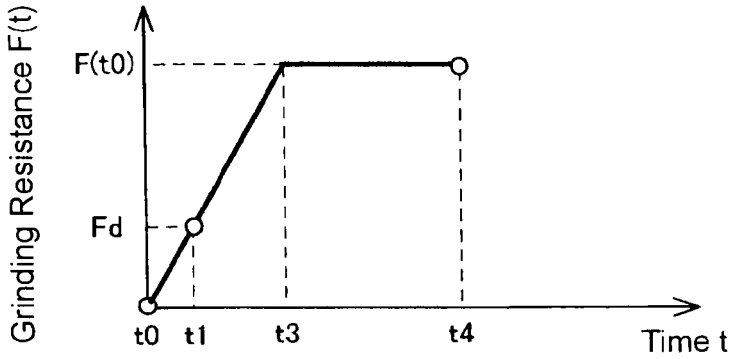
Figure 29C:
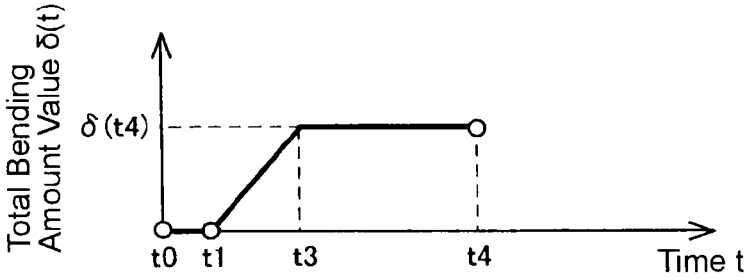

The proportionality constant inference section 106 infers a proportionality constant $\beta$ which represents the relation between the total bending amount value $\delta$(t4) at the completion time t4 of the advance grinding and the second grinding amount E(t4) of the workpiece W. Hereafter, an inference method for the proportionality constant $\beta$ will be described with reference to FIGS. 29(*a*)-29(*c*). FIG. 29(*a*) shows a typical behavior of the radius decrease amount (grinding amount) E(t) of the workpiece W for the period from the starting time t1 to the completion time t4 (shown in FIG. 26) of the advance grinding. FIG. 29(*b*) shows a typical behavior of the grinding resistance F(t) for the same period (t1 to t4). Further, FIG. 29(*c*) shows the total bending amount value δ(t) for the same period (t1 to t4).

The relation between the grinding resistance F(t4) and the grinding amount E(t4) at the completion time t4 of the advance grinding can be expressed by the following expression (12) by taking into consideration the fact that the second grinding amount E(t4) and the grinding resistance F(t4) are in proportion to each other and the grinding resistance Fd developed by a dynamic pressure effect caused by coolant fluid. Here, α indicates a proportionality constant. Further, the following expression (13) can be derived from the expressions (12) and (8). From this expression (13), it is understood that the second grinding amount E(t4) and the total bending amount value δ(t4) are in proportion to each other.

$$F(t4) = \alpha \cdot E(t4) + F_d \tag{12}$$

$$\begin{aligned} E(t4) &= \frac{1}{\alpha} \cdot (F(t4) - F_d) \\ &= \frac{1}{\alpha} \cdot (k_m \cdot \omega d(t4)) \\ &= \beta \cdot \delta(t4) \end{aligned} \tag{13}$$

here:

$$\beta = \frac{k_m}{\alpha}$$

As mentioned above, although it is understood that the second grinding amount E(t4) and the total bending amount value δ(t4) are in proportion to each other, it is unable to calculate the proportionality constant β from the expression (13). Therefore, identifying the proportionality constant β is done in the transition state in the advance grinding, that is, for the period from the starting of the advance grinding to a state that the grinding amount E(t) and the total bending amount value δ(t) become constant. At each time $t_i$ during this period, the residual grinding amount $E^{rest}(t_i)$ is expressed by the difference between the moving amount $\Delta Xd(t_i)$ and the grinding amount $E(t_i)$. The sum total of the residual grinding amounts $E^{rest}(t_i)$ at respective times $t_i$ is expressed by the following expression (14).

$$\sum_{i=1}^{N} E^{rest}(t_i) = \sum_{i=1}^{N} \{\Delta Xd(t_i) - E(t_i)\} \tag{14}$$

Here, the amount $\Delta Xd(t_i)$ can be calculated by the aforementioned wheel head moving amount calculation section 104. Further, the grinding amount $E(t_i)$ can be calculated by the grinding amount calculation section 105.

Further, the sum total of the residual grinding amounts $E^{rest}(t_i)$ at respective times $t_i$ is considered to be equal to the total bending amount value δ(t4) because it corresponds to an escape amount from the sum total of the moving amounts $\Delta Xd(t_i)$. Identifying the proportionality constant β is done on the basis of these information. The proportionality constant β is expressed by the following expression (15). Further, the proportionality constant β is expressed by the following expression (16) by using the grinding resistance F(t4) at the completion time t4 of the advance grinding and the grinding resistance Fd developed by the dynamic pressure effect equivalent caused by coolant fluid. That is, it is understood that the proportionality constant β is expressed and identified by the second grinding amount E(t4) at the completion time t4 of the advance grinding and the difference between the moving amount $\Delta Xd(t_i)$ and the grinding amount $E(t_i)$.

The proportionality constant β changes with the difference in kind of workpieces W or the changes in sharpness of the grinding wheel 43. Therefore, in the present embodiment, it is carried out to infer the proportionality constant β each time the advance grinding is performed right before the retraction grinding.

$$\beta = \frac{k_m}{\alpha} \tag{15}$$

$$\begin{aligned} \beta &= \frac{k_m}{\alpha} \\ &= \frac{\dfrac{F(t4) - F_d}{\sum_{i=1}^{N} E^{rest}(t_i)}}{\dfrac{F(t4) - F_d}{E(t4)}} \\ &= \frac{E(t4)}{\sum_{i=1}^{N} E^{rest}(t_i)} \\ &= \frac{E(t4)}{\sum_{i=1}^{N} \{\Delta Xd(t_i) - E(t_i)\}} \end{aligned} \tag{16}$$

The bending amount parameter setting section 107 inputs and stores therein the moving amount $\Delta Xd(t_i)$ calculated by the wheel head moving amount calculation section 104, the grinding amount $E(t_i)$ calculated by the grinding amount calculation section 105 and the proportionality constant β inferred by the proportionality constant inference section 106. Then, the bending amount parameter setting section 107 calculates the total bending amount value δ(t4) at the completion time t4 of the advance grinding. The total bending amount value δ(t4) at the completion time t4 of the advance grinding is expressed by the following expression (17).

$$\delta(t4) = \frac{E(t4)}{\beta} \tag{17}$$

Next, the retraction grinding will be described. The retraction grinding is controlled using a target bending amount generation section 108, a subtracter 109, the aforementioned target head position generation section 110, the switching device 101, the subtracter 102, the motor control section 103 and the linear scale 45 in the control block diagram shown in FIG. 28.

Figure 30A:
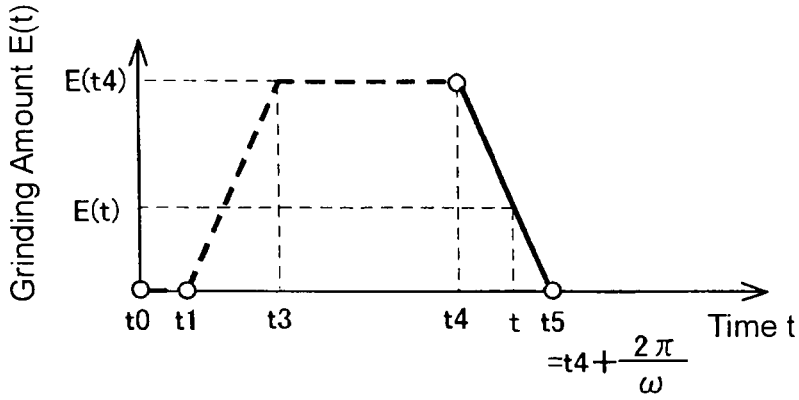
FIGS. 30(*a*) and 30(*b*) are graphs respectively showing target grinding amount E(t) and target total bending amount value δ(t) in a retraction grinding in the eighth embodiment.
Figure 30B:
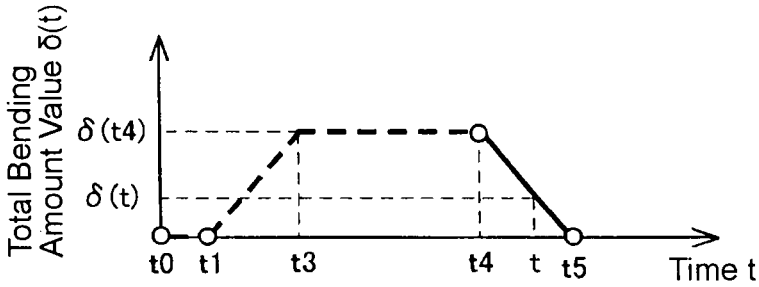

The target bending amount generation section 108 generates a target total bending amount value δ(t) based on the total bending amount value δ(t4) at the completion time t4 of the advance grinding which value is stored in the bending amount parameter setting section 107. The target total bending amount value δ(t) will be described with reference to FIGS. 30(*a*) and 30(*b*). FIG. 30(*a*) shows the target grinding amount E(t) in the retraction grinding, while FIG. 30(*b*) shows the target total bending amount value δ(t) in the retraction grinding.

Consideration is now taken as to the total bending amount value δ(t) which is used in removing the grinding remainder which is left without being ground at the completion time t4 of the advance grinding. The grinding remainder at the completion time t4 of the advance grinding is assumed to be decreased linearly while the workpiece W rotates from the rotational phase θt at the completion time t4 of the advance grinding to reach the rotational phase θe at the completion time t5 of the retraction grinding after one complete turn, and is also assumed to become zero at the time t5 when the rotational phase θe is reached.

In the case of being so assumed, as shown in FIG. 30(*a*), the grinding amount E(t) is decreased linearly with the lapse of time where the workpiece W is rotated at a fixed rotational speed. This can be expressed by the following expression (18). Then, form the relation of E(t)=β·δ(t), the expression (18) can be expressed as the following expression (19). Further, the expression (19) can be expressed by the following expression (20) when transformed into an expression which calculates the total bending amount value δ(t).

$$E(t) = E(t4)\cdot\left\{1 - \frac{\omega}{2\pi}\cdot(t - t4)\right\} \tag{18}$$

$$\beta\cdot\delta(t) = E(t4)\cdot\left\{1 - \frac{\omega}{2\pi}\cdot(t - t4)\right\} \tag{19}$$

$$\begin{aligned}\delta(t) &= \frac{E(t4)}{\beta}\cdot\left\{1 - \frac{\omega}{2\pi}\cdot(t - t4)\right\} \\ &= \delta(t4)\cdot\left\{1 - \frac{\omega}{2\pi}\cdot(t - t4)\right\}\end{aligned} \tag{20}$$

Therefore, it can be understood that in the retraction grinding, it is possible by controlling the total bending amount value δ(t) to make the grinding amount agree with the target value, in other words, to remove the grinding remainder. Thus, where the total bending amount value δ(t4) at the completion time t4 of the advance grinding is calculated by using the expression (20), it is possible to obtain the total bending amount value δ(t). The total bending amount value δ(t4) at the completion time t4 of the advance grinding is stored in the bending amount parameter setting section 107.

The subtracter 109 subtracts the total bending amount value δ(t4) at the completion time t4 of the advance grinding which is stored in the bending amount parameter setting section 107, from the target total bending amount value δ(t) in the retraction grinding which is generated by the target bending amount generation section 108.

Figure 31:
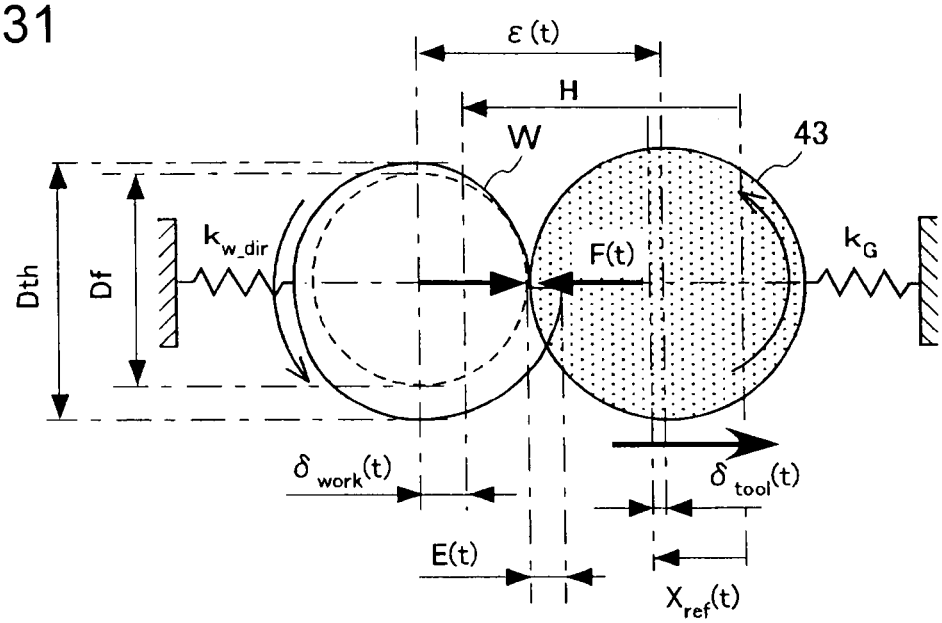
FIG. 31 is an explanatory view for showing the positions of the workpiece and the grinding wheel when the retraction grinding is being performed.

The target head position generation section 110 generates the X-axis position command values $X_{ref}$(t) of the wheel head 42 in the retraction grinding based on the value calculated by the subtracter 109 and the X-axis position Xd(t4) of the wheel head 42 at the completion time t4 of the advance grinding which position is detected by the linear scale 45. The generation method will be described with reference to FIGS. 27 and 31. FIG. 27 is an illustration for indicating the positions of the grinding wheel 43 and the workpiece W at the completion time of the advance grinding. FIG. 31 is an illustration for indicating the positions of the grinding wheel 43 and the workpiece W in the course of the retraction grinding being performed.

At the completion time t4 of the advance grinding, the following expression (21) can be derived from the geometrical relationship. Also in the course of the retraction grinding being performed, the following expression (22) can likewise be derived from the geometrical relationship.

$$\begin{aligned}X_{ref}(t4) &= -\varepsilon(t4) + H + \delta_{tool}(t4) + \delta_{work}(t4) \\ &= -\varepsilon(t4) + H + \delta(t4)\end{aligned} \tag{21}$$

$$\begin{aligned}X_{ref}(t) &= -\varepsilon(t) + H + \delta_{tool}(t) + \delta_{work}(t) \\ &= -\varepsilon(t) + H + \delta(t)\end{aligned} \tag{22}$$

ϵ(t): Center-to-center distance between grinding wheel and workpiece at time t

H: X-axis position of work spindle

At the completion time t4 of the advance grinding, a part of the workpiece W has been ground to the finish diameter Df. Then, the retraction grinding is implemented in the remaining rotational phase θ of the workpiece W. That is, the center-to-center distance ϵ(t) between the grinding wheel 43 and the workpiece W in the retraction grinding being performed is in agreement with the center-to-center distance ϵ(t4) between the grinding wheel 43 and the workpiece W at the completion time t4 of the advance grinding. Thus, the following expression (23) can be derived.

$$\epsilon(t)=\epsilon(t4) \tag{23}$$

The following expression (24) can be derived by substituting the expression (23) into the expressions (21) and (22) and by calculating the difference between both sides of the substituted expressions (21) and (22). Then, the expression (24) can be expressed as the following expression (25) which is transformed to calculate the X-axis position command value $X_{ref}$(t). The target head position generation section 110 calculates the X-axis position command values $X_{ref}$(t) of the wheel head 42 in the retraction grinding in accordance with the expression (25).

$$X_{ref}(t)-X_{ref}(t4)=\delta(t)-\delta(t4) \tag{24}$$

$$X_{ref}(t)=X_{ref}(t4)+\delta(t)-\delta(t4) \tag{25}$$

Then, the switching device 101 is switched over to input the X-axis position command values $X_{ref}$(t) of the wheel head 42 from the target head position generation section 110. This switching-over is carried out when the outer diameter D(t) of the workpiece W detected by the sizing device 60 reaches the set value Dth. Further, the operations of the subtracter 102 and the motor control section 103 are the same as those in the foregoing advance grinding.

With the aforementioned construction, in the retraction grinding, a desired grinding amount can be set by changing the relative position between the workpiece W and the grinding wheel 43 on the basis of the total bending amount value δ(t) being as an indicator, and therefore, it can be realized to perform a precise retraction grinding. Further, the proportionality constant β is inferred in the course of the advance grinding. Accordingly, it is possible to obtain a precise proportionality constant β for the retraction grinding to be performed following the advance grinding. For example, the proportionality constant β changes in dependence on the difference in kind of cylindrical workpieces and the change in sharpness of the grinding wheel. However, since the proportionality constant β is inferred in the advance grinding which is right before the retraction grinding, the proportionality constant β becomes precise. As a result, it is possible to make the grinding amount in the retraction grinding one as precisely desired.

Further, by taking the influence of a dynamic pressure developed by coolant fluid into consideration, it is possible to perform the retraction grinding precisely based on the total bending amount value δ(t). That is, although during the grinding of the workpiece W with the grinding wheel 43, the workpiece W and the grinding wheel 43 are bent or flexed due to a resistance component which is developed by the influence of a dynamic pressure caused by coolant fluid, the influence of the dynamic pressure caused by coolant fluid is reliably excluded, so that a precise grinding can be realized.

Further, the calculation of the total bending amount value δ(t) is made without using other sensors than the sizing device 60 and the linear scale 45. This results in a reduction in cost.

(Modified Forms of Eighth Embodiment)

Further, in the foregoing eighth embodiment, the total bending amount value δ(t) is calculated based on information detected by the sizing device 60 and the linear scale 45. Instead, it is possible to provide a sensor which is capable of detecting the total bending amount value δ(t) directly. In this case, it is also possible to utilize the total bending amount value δ(t) detected by such a sensor in identifying the proportionality constant β.

Further, the advance grinding is executed in accordance with NC data without using the total bending amount value δ(t) at all. Instead, as described earlier, it is possible in the present embodiment to calculate or detect the total bending amount value δ(t). Thus, in the advance grinding, it is possible to control the position of the wheel head 42 by the use of the total bending amount value δ(t). As a result, it is possible to suppress a tapered error caused by a bending amount.

Further, in the foregoing eighth embodiment, description has been made by taking as example the case that the external surface of a cylindrical workpiece W is ground. Instead, the present invention is likewise applicable in the case that the internal surface of a cylindrical workpiece is ground.

Various features and many of the attendant advantages in the foregoing embodiments will be summarized as follows:

In the grinding machine 1 in the foregoing first embodiment shown in FIGS. 1-6(*b*), the first advance grinding control means 70, S1-S3 performs the first advance grinding in which the grinding wheel 43 is relatively moved in the first direction to be pressed on the cylindrical workpiece W to increase the bending amount ω of the cylindrical workpiece W. The target grinding resistance generation means 70, 201 generates the target grinding resistances Fe(θ) in the respective rotational phases θ based on residual grinding amounts E(θ) of the cylindrical workpiece W within a rotational range for the cylindrical workpiece W to rotate from a present rotational phase θt to a target rotational phase θe in the retraction grinding which is to be performed following the first advance grinding in such a way as to move the grinding wheel 43 in the second direction to go away from the cylindrical workpiece W as the bending amount ω of the cylindrical workpiece W is decreased. The retraction grinding control means 70, S4-S6, 203, 204 executes and controls the retraction grinding to make the grinding resistance Ft detected by the grinding resistance detection means 202 agree to the target grinding resistances Fe(θ) in the respective rotational phases θ of the cylindrical workpiece W. Therefore, the retraction grinding is controlled on the basis of the grinding resistance Ft. The grinding amount and the grinding resistance (a resistance generated by grinding the cylindrical workpiece) are in proportion to each other. That is, if residual grinding amounts E(θ) in the respective rotational phases θ can be grasped, it is possible to set the target grinding resistances Fe(θ) which are proportional to the residual grinding amounts E(θ). Therefore, in the retraction grinding, it is possible to perform a feedback control on the basis of the grinding resistance Ft by using the target grinding resistances Fe(θ) as command values in the respective rotational phases θ. As a result, it is possible to enhance the machining accuracy of the cylindrical workpiece W ground in the retraction grinding. Although it may be a case that the grinding resistance Ft detected by the grinding resistance detection means 202 agrees with a grinding resistance developed by the physical contact between the workpiece W and the grinding wheel 43, it may be another case that the grinding resistance Ft becomes the sum of the grinding resistance due to the physical contact and the influence of a dynamic pressure effect brought about by, e.g., coolant fluid. That is, the grinding resistance Ft means at least the grinding resistance due to the physical contact.

In each of the first to the seventh embodiments, since the force sensor 50 provided on the workpiece support device 20, 30 is used as the grinding resistance detection means 202, it is possible to reliably detect the resistance Ft.

Also in the modified form common to the first to seventh embodiments, it is possible to reliably detect the resistance Ft by using the drive torque of the workpiece support device 20, 30.

Also in the first embodiment, since the first advance grinding control means 70, S1-S3 performs the first advance grinding until at least a part of the cylindrical workpiece W reaches a finish diameter Df as shown in FIG. 6(*a*), it is possible to reliably grind the workpiece W to the finish diameter Df in a short period of time in the retraction grinding following the advance grinding.

In the foregoing second embodiment shown in FIGS. 8 and 9, the spark-out grinding is performed. In the second embodiment, the first advance grinding is performed until a part of the workpiece W reaches the finish diameter Df, and the retraction grinding is performed to remove the residual grinding amounts E(θ) relative to the finish diameter Df in the respective rotational phases θ. Thus, theoretically, the spark-out grinding in this embodiment does not produce or generate any grinding amount removed from the workpiece W. However, it may be the case that in each of the first advance grinding and the retraction grinding, the machining accuracy on the ground surface fluctuates due to various causes. Since the spark-out grinding in this embodiment can suppress the fluctuation in the machining accuracy, it can be realized to remarkably improve the surface properties on the ground surface of the cylindrical workpiece W.

Also in the foregoing first embodiment, the grinding resistance Ft is set to become zero when the cylindrical workpiece W reaches the target rotational phase θe, as shown in FIG. 6(*b*). Thus, upon completion of the retraction grinding, the grinding resistance Ft becomes zero. Therefore, it is possible to reliably perform a precise grinding over the whole circumference of the cylindrical workpiece W.

In the foregoing third embodiment shown in FIGS. 10-13, it is possible to perform the feedback control that is reliably on the basis of the grinding resistance Ft, with the influence of a dynamic pressure caused by coolant fluid taken into consideration. It is conventional to use coolant fluid in grinding operations. While the workpiece W is being ground with the grinding wheel 43, a resistance component which is developed by the influence of the dynamic pressure caused by coolant fluid causes the resistance arising on the workpiece W to become larger than the grinding resistance (i.e., the resistance developed by the physical contact between the workpiece W and the grinding wheel 43). Further, even when the grinding wheel 34 and the workpiece W are out of contact, a resistance arises on the workpiece W due to the influence of a dynamic pressure caused by coolant fluid if the separation distance therebetween is very little. That is, because a resistance component developed by the influence of the dynamic pressure in coolant fluid causes the workpiece W to be bent, it is likely that a grinding remainder arises even if the grinding resistance Ft becomes zero. Therefore, in the foregoing third embodiment, as shown in FIG. 13, by setting the target grinding resistance Fe(θ) so that the grinding resistance Ft becomes the dynamic pressure effect equivalent value Fϵ1 when the target rotational phase ee is reached (i.e., when the retraction grinding is completed), it becomes possible to reliably exclude the influence of the dynamic pressure caused by coolant fluid, so that a precise grinding can be realized.

Also in the foregoing third embodiment, by utilizing the fact that the decrease amount of the ground workpiece diameter and the grinding resistance are in a linear proportion to each other as shown in FIG. 12, it is possible to reliably infer the value Fϵ1 equivalent to the dynamic pressure effect (FIG. 10, S15). Thus, it is possible to perform a precise grinding taking the dynamic pressure effect equivalent value Fϵ1 into consideration.

Also in the foregoing third embodiment, the value Fϵ1 equivalent to the dynamic pressure effect caused by coolant fluid is inferred based on the information acquired in the transition state of the advance grinding which is right before the retraction grinding to be then performed (FIG. 10, S15). By utilizing the information in the transition state, it is possible to reliably infer the value Fϵ1 equivalent to the dynamic pressure effect caused by coolant fluid. It may take place that the value Fϵ1 equivalent to the dynamic pressure effect caused by coolant fluid fluctuates in dependence on, e.g., the sharpness of the grinding wheel. Therefore, in the foregoing third embodiment, by utilizing the information in the transition state of the advance grinding being performed right before, it is possible to reliably infer the value Fϵ1 equivalent to the dynamic pressure effect caused by coolant fluid in the retraction grinding to be then performed.

The transition state is a state in which the bending amount of a cylindrical workpiece gradually increases as a grinding wheel is moved into a state (grinding) to be depressed on the cylindrical workpiece. At this time, because the cylindrical workpiece is bent, the grinding amount become less than the relative moving amount of the grinding wheel. Then, the time-dependent change in the relative moving amount of the grinding wheel and the time-dependent change in the outer diameter of the cylindrical workpiece last in a different state until the time-dependent change in the grinding amount of the cylindrical workpiece comes to agreement with the time-dependent change in the relative moving amount of the grinding wheel. The different state is called "transient state". That is, in the transient state, the relative moving amount of the grinding wheel and the outer diameter of the cylindrical workpiece are in a nonlinear relation. A stationary state arises as a state opposite to the transition state. The stationary state is a state in which the time-dependent change in the relative moving amount of the grinding wheel and the time-dependent change in the outer diameter of the cylindrical workpiece come to agree with each other. That is, in the stationary state, the bending amount of the cylindrical workpiece is kept constant or stable. Further, in the stationary state, the time-dependent change in the relative moving amount of the grinding wheel and the time-dependent change in the outer diameter of the cylindrical workpiece become a linear relation.

Figure 15:
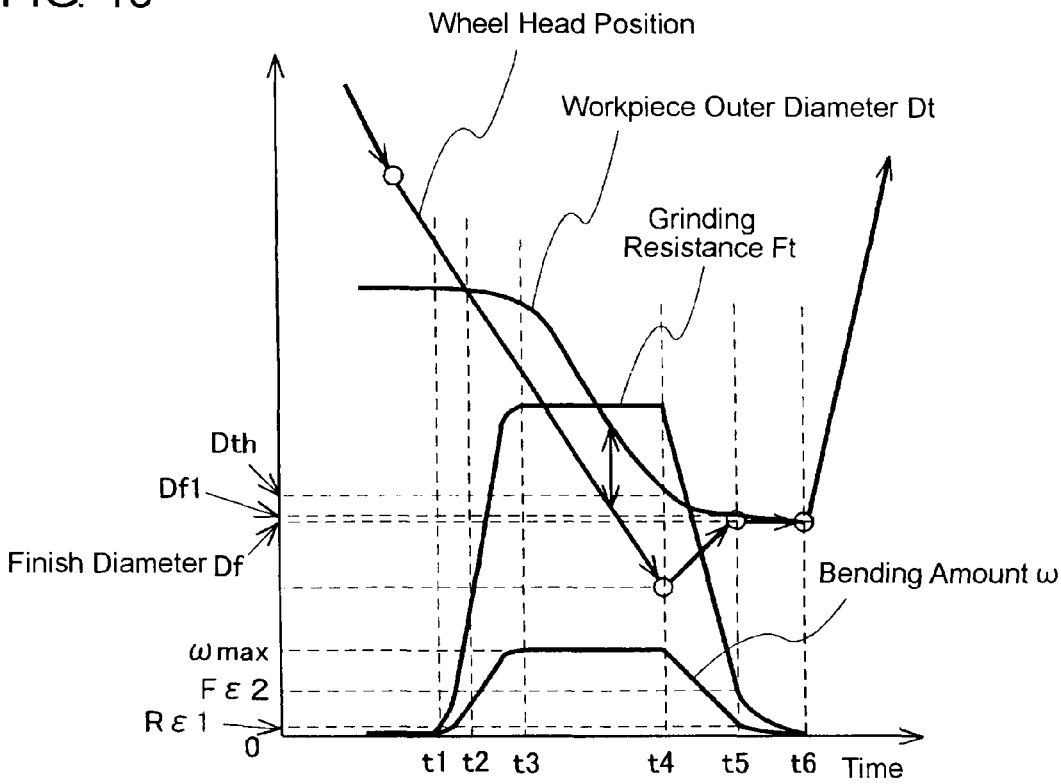
FIG. 15 is a graph showing wheel head position, workpiece outer diameter Dt, grinding resistance Ft and bending amount ω with the lapse of time in the fourth embodiment.

In the foregoing fourth embodiment shown in FIGS. 14-16, it is designed that the workpiece W has the residual grinding allowance Rϵ1 when the target rotational phase θe is reached in the retraction grinding, as shown in FIG. 15. Thus, the residual grinding allowance becomes the predetermined value Rϵ1 at the completion time t5 of the retraction grinding. Since the remaining predetermined value Rϵ1 can be removed in the spark-out grinding, it is possible to obtain a precise shape on the workpiece after completion of the spark-out grinding.

As mentioned earlier, it is known that the grinding amount and the grinding resistance are in proportional to each other. Thus, in the foregoing fourth embodiment, as shown in FIG. 15, the target grinding resistance Fe(θ) is set to make the grinding allowance Rϵ2 corresponding to the grinding resistance Ft remain at the completion time t5 of the retraction grinding. As a result, it is possible to grind the residual grinding allowance Rϵ1 reliably in the spark-out grinding.

In each of the foregoing first to fourth embodiments, the target grinding resistance generation means 201 (FIG. 4) sets to one complete turn of the cylindrical workpiece W the rotational angular phase for the cylindrical workpiece W to turn from the present rotational phase θt to the target rotational phase θe. Therefore, the retraction grinding can be completed within the shortest period of time, so that it becomes possible to remarkably shorten the whole grinding period of time for the cylindrical workpiece W.

In the foregoing fifth embodiment shown in FIGS. 17-19, the retraction grinding is performed through plural numbers of workpiece rotations. That is, the retraction grinding with the workpiece rotating at a later time operates like a finish grinding. Thus, it is possible to perform in turn a retraction grinding equivalent to a rough grinding, a retraction grinding equivalent to a fine grinding, a retraction grinding equivalent to a minute grinding and so on while the retraction grinding is performed during the plural turns of the workpiece W. As a result, it is possible to perform a grinding operation which is very high in precision.

Also in the foregoing fifth embodiment, it is possible to reliably remove in the retraction grinding the affected layer which is made in the first advance grinding. Accordingly, the cylindrical workpiece W on which the retraction grinding is completed does not have an affected layer.

It is theoretically considered that at the completion time of the first advance grinding, the cylindrical workpiece has the residual grinding amounts E(θ) which change linearly over one complete turn from the present rotational phase θt. However, it may be the case in the actual grinding machine that the residual grinding amounts E(θ) change nonlinearly in the respective rotational phases θ within one rotation due to changes in the machine rigidity of the grinding machine, the sharpness of the grinding wheel and so on.

Therefore, in the foregoing sixth embodiment shown in FIGS. 20(*a*) through 23, even where at the completion time t4 of the first advance grinding, the cylindrical workpiece W has the residual grinding amounts E(θ) which change nonlinearly from the present rotational phase θt to the target rotational phase θe, it is possible to set the target grinding resistances Fe(θ) to those depending on the residual grinding amounts E(θ), as shown in FIG. 23. That is, the residual grinding amount in the first advance grinding can reliably be ground in the retraction grinding. Accordingly, it is possible to enhance the grinding accuracy.

Also in the sixth embodiment, the inferred values of the residual grinding amounts E(θ) in the respective rotational phases θ can be obtained more reliably.

Figure 25:
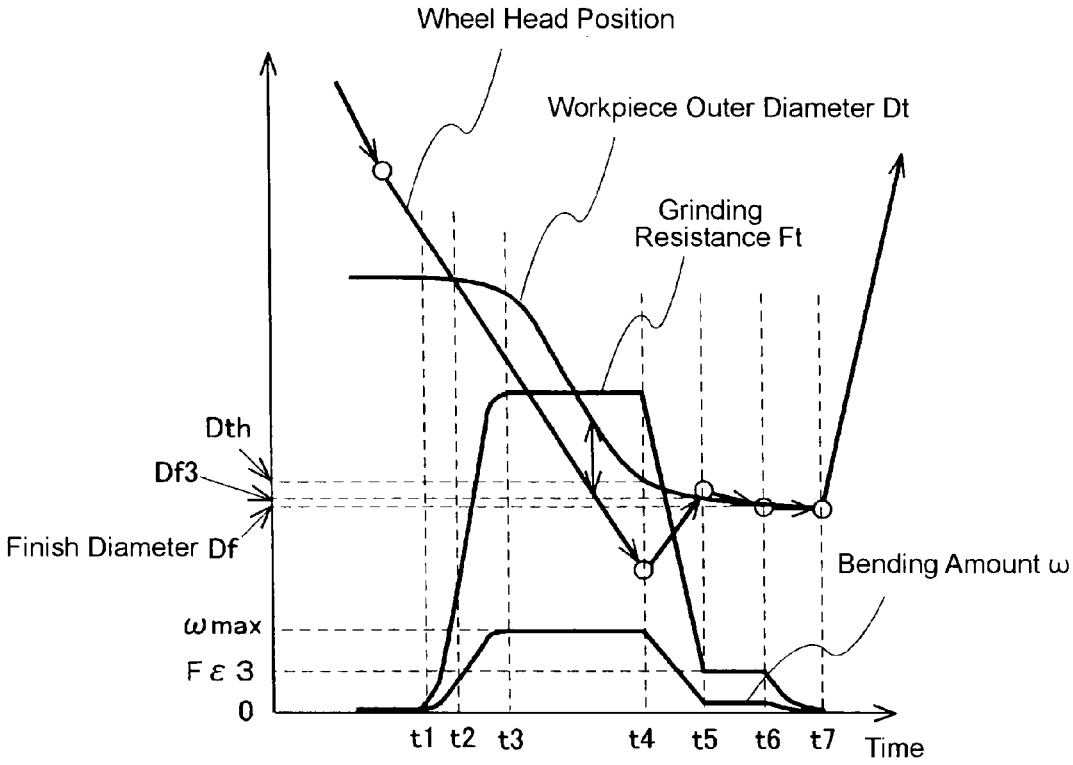
FIG. 25 is a graph showing wheel head position, workpiece outer diameter Dt, grinding resistance Ft and bending amount ω with the lapse of time in the seventh embodiment.

In the foregoing seventh embodiment shown in FIGS. 24 and 25, the second advance grinding which is controlled to make the grinding resistance Ft constant is performed (t5-t6 in FIG. 25) following the retraction grinding. Thus, even if a non-uniformity (or variation) in dimensions over respective rotational phases θ arises in the retraction grinding, such a non-uniformity can reliably be removed in the second advance grinding. Accordingly, a precise grinding can be realized.

The second advance grinding is an advance grinding which is controlled to make the grinding resistance constant (t5-t6 in FIG. 25). Therefore, theoretically, it is considered that a step is produced between a part of the workpiece W at which part the second advance grinding is completed, and another part of the workpiece W in a rotational phase θ being ahead a little. In the foregoing seventh embodiment, the step can be removed by performing the spark-out grinding (t6-t7 in FIG. 25). That is, even if such a step is produced in the second advance grinding, it is possible to make the finally ground finish surface precise by the spark-out grinding.

Again in the foregoing first embodiment shown in FIG. 1-6(*b*), the switching point from the first advance grinding to the retraction grinding is judged in dependence on the ground diameter Dt of the cylindrical workpiece W (FIG. 2, S2). Therefore, it is possible to make the switching from the first advance grinding to the retraction grinding when the grinding wheel is at an appropriate position.

In the foregoing eighth embodiment shown in FIGS. 26-31, the retraction grinding is carried out as the relative position command values $X_{ref}(t)$ of the grinding wheel 43 relative to the cylindrical workpiece W are generated based on the target total bending amount values δ(t) of the cylindrical workpiece W and the grinding wheel 43. It is known that the total bending amount δ(t) of the cylindrical workpiece W and the grinding wheel 43 and a grinding amount E(t) are in proportion to each other. Thus, by changing the relative position between the cylindrical workpiece and the grinding wheel on the basis of the total bending amount values δ(t), a desired grinding amount can be attained, so that it is possible to realize a precise retraction grinding.

Also in the foregoing eighth embodiment, since the position command value generation means 110 is configured to generate the position command values $X_{ref}(t)$ based on the target total bending amount value δ(tn) which arises at a completion time to of the advance grinding, it is possible to generate the position command value $X_{ref}(t)$ reliably.

Also in the foregoing eighth embodiment, by inferring the proportionality constant β, it is possible to make clear the relation between the total bending amount value δ(t) and the grounding amount E(t), as shown in FIGS. 30(*a*) and 30(*b*). Thus, it is possible to reliably obtain a desired grinding amount in the retraction grinding. The grinding amount of the cylindrical workpiece W is a radius decrease amount of the workpiece W in a predetermined period of time and corresponds to the infeed amount in the radial direction of the grinding wheel 43 against the workpiece W in the predetermined period of time.

Also in the foregoing eighth embodiment, the proportionality constant β is inferred in the course of the advance grinding. Accordingly, it is possible to obtain a precise proportionality constant β for the retraction grinding to be performed following the advance grinding. For example, the proportionality constant β changes in dependence on the difference in kind of cylindrical workpieces and the change in sharpness of the grinding wheel. However, since the proportionality constant β is inferred in the advance grinding which is performed right before the retraction grinding, the proportionality constant β becomes precise. As a result, it is possible to make the grinding amount in the retraction grinding a desired one more reliably.

Also in the foregoing eighth embodiment, since the bending amount detection means 107, 108 is configured to calculate the total bending amount value δ(tn) of the cylindrical workpiece W and the grinding wheel 43 at the completion time t4 of the advance grinding based on the first grinding amount $E(t_i)$ and the moving amount $\Delta Xd(t_i)$, it is possible to reliably obtain the total bending amount value δ(tn) at the completion time t4 of the advance grinding.

Also in the foregoing eighth embodiment, by taking the influence of a dynamic pressure developed by coolant fluid into consideration, it is possible to perform the retraction grinding precisely based on the total bending amount value δ(t). That is, although during the grinding of the workpiece W with the grinding wheel 43, the workpiece W and the grinding wheel 43 are bent or flexed due to a resistance component which is developed by the influence of a dynamic pressure caused by coolant fluid, the influence of the dynamic pressure caused by coolant fluid is reliably excluded, so that a precise grinding can be realized.

Also in the foregoing eighth embodiment, as shown in FIGS. 26, 30(*a*) and 30(*b*), since the retraction grinding is completed when the workpiece W completes one complete turn (t4-t5), it is possible to complete the grinding in a short period of time.

Also in the foregoing eighth embodiment, as shown in FIG. 28, the switching from the advance grinding to the retraction grinding is made using the signal from the sizing device 60. Thus, it is possible to make the switching from the advance grinding to the retraction grinding reliably and precisely.

In the grinding method in the foregoing first embodiment, it is possible to achieve the same effects and advantages of those in the grinding machine 1 in the foregoing first embodiment. Further, also in the grinding method in the foregoing first embodiment, other features in the foregoing grinding machine 1 are also applicable likewise, and thus, the same effects and advantages as attained by such other features can also be attained.

In the grinding method in the foregoing eighth embodiment, it is possible to achieve the same effects and advantages of those in the grinding machine 1 in the foregoing eighth embodiment. Further, also in the grinding method in the foregoing eighth embodiment, other features in the foregoing grinding machine 1 in the eight embodiments are also applicable likewise, and thus, the same effects and advantages as attained by such other features can also be attained.

Obviously, further numerous modifications and variations of the present invention are possible in light of the above teachings. It is therefore to be understood that within the scope of the appended claims, the present invention may be practiced otherwise than as specifically described herein.

What is claimed is:

1. A grinding machine for grinding an external or internal surface of a cylindrical workpiece, comprising:

a grinding wheel;

a workpiece support device for rotatably supporting and driving the cylindrical workpiece;

a feed device for relatively moving the cylindrical workpiece and the grinding wheel to move the cylindrical workpiece and the grinding wheel toward and away from each other;

grinding resistance detection means for detecting a grinding resistance which is generated by grinding the cylindrical workpiece with the grinding wheel;

first advance grinding control means for performing a first advance grinding in which the grinding wheel is relatively moved in a first direction to be pressed on the cylindrical workpiece to increase a bending amount ω of the cylindrical workpiece;

target grinding resistance generation means for generating target grinding resistances Fe(θ) in respective rotational phases θ based on residual grinding amounts E(θ) in the respective rotational phases θ of the cylindrical workpiece within a rotational range for the cylindrical workpiece to rotate from a present rotational phase θt to a target rotational phase θe in a retraction grinding which is to be performed following the first advance grinding in such a way as to relatively move the grinding wheel in a second direction to go away from the cylindrical workpiece as the bending amount ω of the cylindrical workpiece is decreased; and retraction grinding control means for executing and controlling the retraction grinding to make the grinding resistance Ft detected by the grinding resistance detection means agree with the target grinding resistances Fe(θ) in the respective rotational phases θ of the cylindrical workpiece.

2. The grinding machine as set forth in claim 1, wherein the grinding resistance detection means comprises a force sensor provided on the workpiece support device.

3. The grinding machine as set forth in claim 1, wherein the grinding resistance detection means comprises torque detection means for detecting a drive torque which the workpiece support device generates in rotationally driving the cylindrical workpiece.

4. The grinding machine as set forth in claim 1, wherein:

the first advance grinding control means is configured to perform the first advance grinding until at least a part of the cylindrical workpiece reaches a finish diameter Df; and the residual grinding amounts E(θ) in the respective rotational phases θ are residual grinding amounts relative to the finish diameter Df in the respective rotational phases θ.

5. The grinding machine as set forth in claim 1, wherein:

the first advance grinding control means is configured to perform the first advance grinding until at least a part of the cylindrical workpiece reaches a finish diameter Df;

the residual grinding amounts E(θ) in the respective rotational phases θ are residual grinding amounts relative to the finish diameter Df in the respective rotational phases θ; and the grinding machine further comprises:

spark-out grinding control means for performing, after the retraction grinding, a spark-out grinding with an infeed amount of the grinding wheel against the cylindrical workpiece held zero.

6. The grinding machine as set forth in claim 1, wherein the target grinding resistance generation means is configured to generate the target grinding resistances Fe(θ) so that the grinding resistance Ft becomes zero when the cylindrical workpiece reaches the target rotational phase θe.

7. The grinding machine as set forth in claim 1, wherein the target grinding resistance generation means is configured to generate the target grinding resistances Fe(θ) so that when the cylindrical workpiece reaches the target rotational phase θe, the grinding resistance Ft becomes a value Fϵ1 corresponding to a dynamic pressure effect which is brought about by coolant fluid between the cylindrical workpiece and the grinding wheel.

8. The grinding machine as set forth in claim 7, further comprising:

a sizing device for measuring a ground diameter Dt of the cylindrical workpiece; and inference means for inferring as an inference value the value Fϵ1 equivalent to the dynamic pressure effect based on a decrease amount of the ground diameter Dt of the cylindrical workpiece and the grinding resistance Ft detected by the grinding resistance detection means;

wherein the target grinding resistance generation means is configured to generate the target grinding resistances Fe(θ) based on the inference value Fϵ1 obtained by the inference means.

9. The grinding machine as set forth in claim 8, wherein the inference means is configured to infer the value Fϵ1 equivalent to the dynamic pressure effect based on the decrease amount of the ground diameter Dt of the cylindrical workpiece and the grinding resistance Ft in a transition state that the bending amount ω of the cylindrical workpiece is changing.

10. The grinding machine as set forth in claim 1, wherein:

the first advance grinding control means is configured to control the first advance grinding to leave a residual allowance Rϵ1 from the finish diameter Df at at least a part of the cylindrical workpiece;

the residual grinding amounts E(θ) in the respective rotational phases θ are residual grinding amounts each of which is the residual allowance Rϵ1 left from the finish diameter Df in each of the respective rotational phases θ; and the grinding machine further comprises:

spark-out grinding control means for performing a spark-out grinding after the retraction grinding, to grind the residual allowance Rϵ1 in each of the respective rotational phases θ with an infeed amount of the grinding wheel against the cylindrical workpiece held zero.

11. The grinding machine as set forth in claim 1, wherein the target grinding resistance generation means is configured to generate the target grinding resistances Fe(θ) in the respective rotational phases θ so that when the cylindrical workpiece reaches the target rotational phase θe, the grinding resistance Ft becomes a predetermined value Fϵ2.

12. The grinding machine as set forth in claim 1, wherein the rotational range for the cylindrical workpiece to rotate from the present rotational phase θt to the target rotational phase θe within which range the target grinding resistance generation means generates the target grinding resistances Fe(θ) is set to a rotational range for the cylindrical workpiece to rotate through one complete turn.

13. The grinding machine as set forth in claim 1, wherein:

the first advance grinding control means is configured to control the first advance grinding to leave a residual allowance Rϵ2 from the finish diameter Df at at least a part of the cylindrical workpiece; and the rotational range for the cylindrical workpiece to rotate from the present rotational phase θt to the target rotational phase θe within which range the target grinding resistance generation means generates the target grinding resistances Fe(θ) is set to a rotational range for the cylindrical workpiece to rotate through turns of plural numbers.

14. The grinding machine as set forth in claim 13, further comprising:

depth inference means for inferring the depth of an affected layer made in the first advance grinding;

wherein the first advance grinding control means is configured to control the first advance grinding with the residual allowance Rϵ2 set to a depth which is equal to or greater than the affected layer.

15. The grinding machine as set forth in claim 1, further comprising:

residual grinding amount inference means for inferring residual grinding amounts E(θ) in the respective rotational phases θ of the cylindrical workpiece at a completion time of the first advance grinding based on the grinding resistances Ft in the respective rotational phases θ which resistances are measured by the grinding resistance detection means in the first advance grinding;

wherein the target grinding resistance generation means is configured to generate the target grinding resistances Fe(θ) based on the residual grinding amounts E(θ) inferred by the residual grinding amount inference means.

16. The grinding machine as set forth in claim 15, wherein the residual grinding amount inference means is configured to infer the residual grinding amounts E(θ) based on the grinding resistances Ft in the respective rotational phases θ and ground diameters Dt in the respective rotational phases θ of the cylindrical workpiece in the first advance grinding.

17. The grinding machine as set forth in claim 1, wherein:

the first advance grinding control means is configured to control the first advance grinding to leave a residual allowance Rϵ3 from the finish diameter Df at at least a part of the cylindrical workpiece; and the grinding machine further comprises:

constant grinding resistance advance grinding control means for performing, after the retraction grinding, a second advance grinding in which the grinding wheel is relatively moved in the first direction to be pressed against the cylindrical workpiece to keep constant the grinding resistances Ft in the respective rotational phases θ.

18. The grinding machine as set forth in claim 17, further comprising:

spark-out grinding control means for performing, after the second advance grinding, a spark-out grinding with an infeed amount of the grinding wheel against the cylindrical workpiece held zero.

19. The grinding machine as set forth in claim 1, wherein the retraction grinding control means is configured to make a switching from the first advance grinding to the retraction grinding when a ground diameter Dt in a predetermined angular phase θ of the cylindrical workpiece reaches a set value.

20. A grinding method of grinding an external or internal surface of a cylindrical workpiece in a grinding machine comprising:

a grinding wheel;

a workpiece support device for rotatably supporting and driving the cylindrical workpiece;

a feed device for relatively moving the cylindrical workpiece and the grinding wheel to move the cylindrical workpiece and the grinding wheel toward and away from each other; and grinding resistance detection means for detecting a grinding resistance Ft which is generated by grinding the cylindrical workpiece with the grinding wheel;

the grinding method comprising:

a first advance grinding step of performing a first advance grinding by relatively moving the grinding wheel in a first direction to be pressed on the cylindrical workpiece to increase a bending amount ω of the cylindrical workpiece;

a target grinding resistance generation step of generating target grinding resistances Fe(θ) in respective rotational phases θ based on residual grinding amounts E(θ) in the respective rotational phases θ of the cylindrical workpiece within a rotational range for the cylindrical workpiece to rotate from a present rotational phase θt to a target rotational phase θe in a retraction grinding which is to be performed following the first advance grinding by moving the grinding wheel in a second direction to go away from the cylindrical workpiece as the bending amount ω of the cylindrical workpiece is decreased; and a retraction grinding control step of executing and controlling the retraction grinding to make the grinding resistance Ft detected by the grinding resistance detection means agree with the target grinding resistances Fe(θ) in the respective rotational phases θ of the cylindrical workpiece.

* * * * *